United States Patent [19]

Duke et al.

[11] Patent Number: 4,889,293

[45] Date of Patent: Dec. 26, 1989

[54] APPARATUS AND METHOD FOR CONTROLLING TENSION IN A MOVABLE WEB

[75] Inventors: Ronald J. Duke, Miamisburg; Jack Beery, Centerville, both of Ohio

[73] Assignee: The Mead Corporation, Dayton, Ohio

[21] Appl. No.: 156,495

[22] Filed: Feb. 16, 1988

[51] Int. Cl.[4] ..... B65H 23/08; B65H 25/22

[52] U.S. Cl. ..... 242/75.51; 318/7; 226/44

[58] Field of Search ..... 242/75.51, 75.44, 75.43; 318/6, 7; 226/44

[56] References Cited

U.S. PATENT DOCUMENTS

| | | | |
|---|---|---|---|
| 3,927,844 | 12/1975 | Bond et al. | 242/75.51 X |
| 3,936,008 | 2/1976 | Crum | 242/75.51 X |
| 4,125,881 | 11/1978 | Eige et al. | 318/7 X |
| 4,126,817 | 11/1978 | Luzio . | |
| 4,366,371 | 12/1982 | d'Alayer de Costemore d'Arc | 318/7 X |
| 4,436,251 | 3/1984 | Deyesso et al. | 318/7 X |
| 4,508,284 | 4/1985 | Kataoka . | |
| 4,527,751 | 7/1985 | Grosz et al. . | |
| 4,565,334 | 1/1986 | Ruhl | 242/75.51 X |
| 4,578,621 | 3/1986 | Nordlof | 318/6 |
| 4,588,143 | 3/1986 | Hetzel | 226/44 X |
| 4,708,301 | 11/1987 | Kataoka | 226/44 X |
| 4,788,558 | 11/1988 | Caldwell et al. | 242/75.51 X |

*Primary Examiner*—Stuart S. Levy
*Assistant Examiner*—Steven M. duBois
*Attorney, Agent, or Firm*—Thomas A. Boshinski

[57] ABSTRACT

Apparatus for controlling tension in a movable web includes a frame supporting a web supply roll, and a torque motor connected to the supply roll. The web is supported along a web path. Web position is measured by a dancer roll biased against the web. A signal representative of the web position is generated and supplied to a control system, which receives the position signal and generates in response a torque signal representative of a torque value to be applied to the roll to cause the actual web position to equal a nominal position. The control system is connected to the torque motor to control the motor in accordance with the torque signal.

15 Claims, 18 Drawing Sheets

| FIG. 4A | FIG. 4B | FIG. 4C |
|---|---|---|

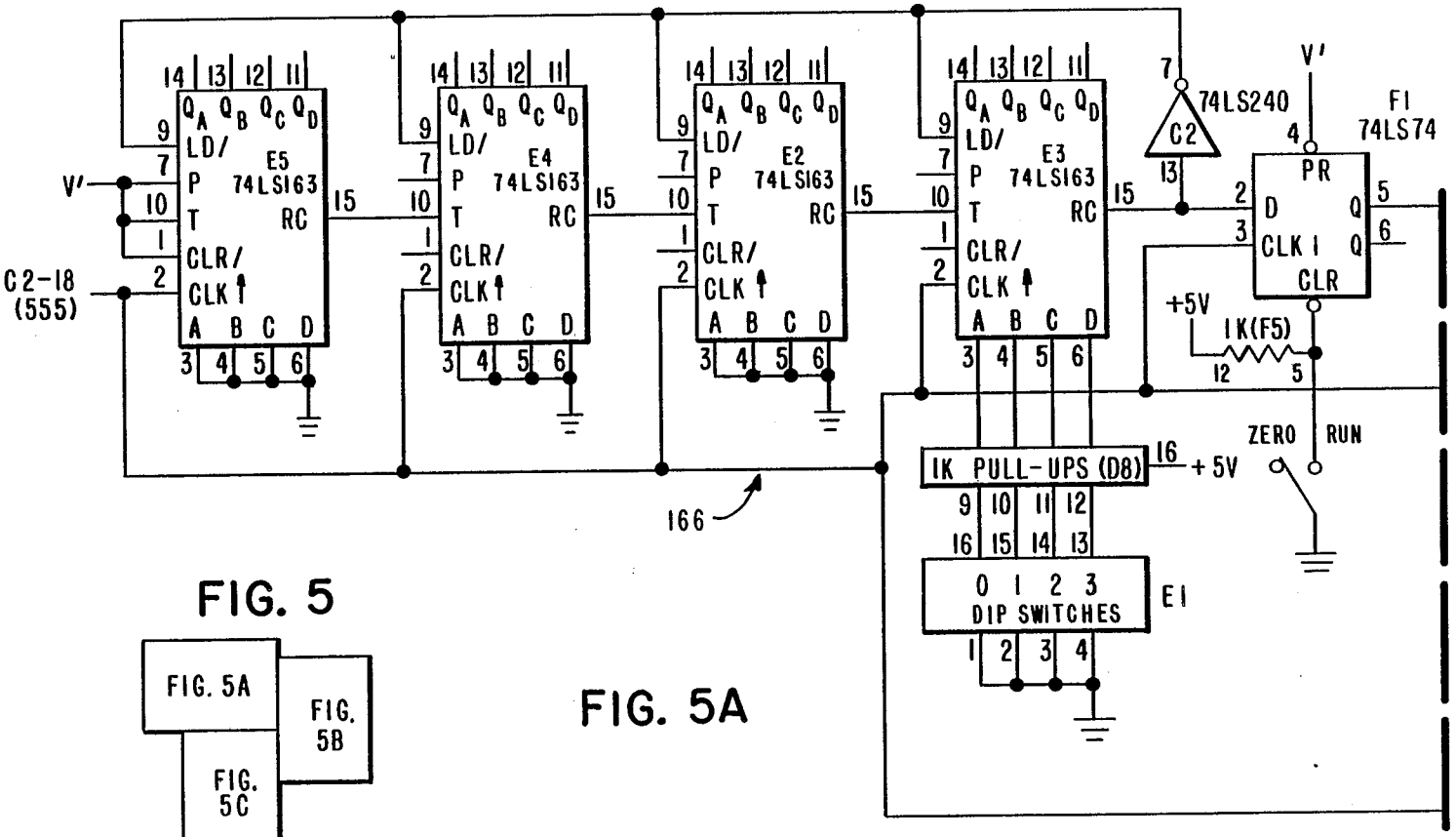
FIG. 5A
FIG. 5
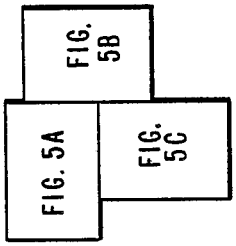

| FIG. 6A | FIG. 6B | FIG. 6C |
|---|---|---|

APPARATUS AND METHOD FOR CONTROLLING TENSION IN A MOVABLE WEB

BACKGROUND OF THE INVENTION

The present invention relates generally to web-handling apparatus. More particularly, the invention relates to an apparatus and method for controlling tension within a web, specifically in web-handling systems wherein the web is moved continuously, intermittently, at varying speeds, or even in a reverse direction.

Many different forms of apparatus are known for handling a moving web. Often, the specific construction and means of operation of these various systems depends in part upon the characteristics of the web material with which the system is designed to operate, as well as the nature of the operations to be performed on the web.

One general class of web material includes photosensitive materials suitable for the reproduction of visual images. One type of such material is disclosed in U.S. Pat. Nos. 4,440,846 and 4,399,209, which describe an imaging media for use with an imaging system. In the media, a photosensitive layer is formed comprising microcapsules containing a photosensitive composition in the internal phase. The photosensitive layer is image-wise exposed to actinic radiation, and subjected to a uniform rupturing force whereupon the microcapsules rupture and image-wise release the internal phase. An image-forming chromogenic material, such as a substantially colorless color former, is typically associated with the microcapsules. When the microcapsules rupture, the color former image-wise reacts with a developer material and produces a color image. In the embodiments described in the referenced patents, the microcapsules are typically ruptured by passing imagewise exposed imaging sheets through the nip between a pair of parallel calender rolls.

This photosensitive media may exist in a form which comprises two layers. The microcapsules are carried on a continuous web referred to as a donor web. The developer composition is coated onto a second, separate substrate layer, typically formed as separate sheet, with each sheet referred to as a receiver sheet. The donor web is subjected to the actinic radiation, and the exposed microcapsule layer is then brought into contact with the developer layer of the receiver sheets. As the sheet and web are subjected to pressure, the finished image is formed in the receiver sheet.

Alternatively, the developer composition may be coated directly onto the web material. In such a case, receiver sheets are not required, and the finished images are produced directly in the web. Typically, the individual images will then require cutting from the web material.

In processing a web of the above-described photosensitive media, or any other photosensitive material, it is necessary to withdraw the material from a supply roll, move the material through an exposure station, and finally through a developer station. Moreover, it is necessary that the various operations on the web be properly registered to ensure proper positioning of the finished image on the output sheets. This in turn requires that web tension be carefully controlled, so that web positioning at the various stations can be accurately determined.

Many various means for controlling tension within a movable web are known. However, when operating upon a photosensitive material, a number of circumstances exist which make proper tension control relatively difficult. For example, exposure is most typically performed with the web stationary at the exposure station. The web is moved between exposures to advance the web, and thus frequent starting and stopping of the web occurs. The various accelerations and decelerations placed upon the web as a result causes significant tension variation within the web. Further, where a single exposure is to be made, a certain amount of web will normally be wasted due to the distance between the exposure and developer stations. To use this material, web motion in a reverse direction may be required. This too can produce substantial tension variation within a web, and also requires winding of the web back onto the supply roll.

One further problem in handling the microencapsulated web described herein is that contact with the web on the side carrying the capsules should be minimized. Otherwise, the capsule layer of the moving web could be damaged, which will in turn produce defective finished images.

What is needed, therefore, is an apparatus and method for controlling the tension within a movable web. Such apparatus and method should be capable of carrying out this function despite frequent accelerations and decelerations within the web, as well as complete reversal of web movement. Further, such an apparatus and method should be capable of compensating for changes in supply roll diameter and other changes in operating conditions. Moreover, the apparatus should operate in contact with only one side of the web.

SUMMARY OF THE INVENTION

In meeting the foregoing needs, the present invention provides apparatus for controlling tension in a movable web, including a frame for supporting a supply roll from which the web may be drawn, and means for applying torque to the supply roll. A nominal web path is defined and the web is located along the nominal path.

Means positioned along the path measures displacement of the web from the nominal path, and generates a signal representative of the web displacement. A control means connected to the displacement measuring means receives the displacement signal and generates in response thereto a torque signal representative of a torque value to be applied to the supply roll to return the web to the nominal path. The control means is further connected to the torque applying means for controlling the torque applying means in accordance with the torque signal.

The displacement measuring means may include a dancer roll positioned in contact with the web, and means for biasing the dancer roll against the web to follow movement of the web. The displacement measuring means generates the displacement signal in response to following movement of the dancer roll against the web.

The dancer roll may be connected to the frame by a pivotal mounting. The positional measuring means may include a potentiometer having a shaft, the shaft being connected to the mounting for rotation in conjunction with pivotal motion of the mounting means.

The control means may include at least one table having a plurality of the torque values, the control means operating by mapping the position to one of the torque values within the table. As an equivalent, the control means may include a plurality of tables, each having at least one torque value.

Alternatively, the control means may include a plurality of tables incrementally ordered, each table having a plurality of the torque values. The control means operates by mapping the web displacement to one of the torque values within a selected one of the tables. A clock means generates a plurality of clock pulses, and a comparator means compares the web displacement with the nominal path and determines whether the web displacement differs in one direction from the nominal path during any one clock pulse. A table selection means is responsive to the comparator means for changing the selected one of the tables whenever the web displacement differs consistently from the nominal path during a predetermined consecutive number of the clock pulses.

The control means may be operative to vary its characteristic response to the displacement signal in generating the torque signal, in accordance with varying diameter of the supply roll, by selecting the appropriate table.

Also, the control means may include a first of the tables having a plurality of torque values each of which is less than a torque necessary to cause the web to be returned to the nominal path, the first table being selected for a limited time period upon start-up of the apparatus. The first table may be further selected during shut-down of the apparatus.

Alternatively, the control means may include means for slowing the clock pulses generated during by the clock means for a limited time period upon start-up of the apparatus. The clock pulse slowing means is further operative during shut-down of the apparatus.

As a still further alternative, the control means may operate to establish at least one limiting torque value, the limiting torque value being used to generate the torque signal instead of a selected one of the torque values from the tables for a limited time period upon start-up of the apparatus, in the event the selected torque value exceeds the limiting torque value. The limiting torque value is further used during shut-down of the apparatus. These limiting torque values may also be varied as the apparatus is started or shut down.

These alternatives may be combined for use during start up and/or shut down of the apparatus.

Rather than mapping displacement values to torque values, the control means may operate by relating the web displacement value to the torque value in accordance with a plurality of predetermined functions expressing the torque value as a function of web displacement. The control means operates to select one of the plurality of functions. A first of the functions may be selected to generate torque values in accordance with web displacement each of which is less than a torque necessary to cause the web to be returned to the nominal path, the first function being selected for a limited time period upon start-up of the apparatus.

The frame means may further support a take-up roll on which the web may be collected. The apparatus further includes means for applying torque to the take-up roll. The control means can then be further adapted to generate in response to the displacement signal a second torque signal representative of a second torque value to be applied to the take-up roll to return the web to the nominal path. The control means is further connected to the means for applying torque to the take-up roll for controlling the torque applying means in accordance with the second torque signal.

The control means may be connected to the means for applying torque to the supply roll, for controlling the supply roll torque applying means in accordance with the second torque signal to control payout of the web. In such a case, the second torque signal could be replaced with a take-up roll velocity signal representative of the angular velocity of the take-up roll, such signal being applied to the control means.

The apparatus may include means for adjusting a nominal tension applied to the web. The nominal tension adjusting means includes means for applying a biasing force to the arm supporting the dancer roll, and means for adjusting the biasing force.

The apparatus may include means for adjusting the nominal position of the web path with respect to the dancer roll. Where the position measuring means includes a potentiometer having a shaft, the shaft being connected to the arm supporting the dancer roll, the means for adjusting the nominal web path includes means for permitting rotational movement of the potentiometer with respect to the arm.

The means for adjusting the nominal web path may also include means within the control means for altering the arm position signal by applying a correction factor thereto to generate adjusted torque signals. In such case, the torque applying means is actually controlled in accordance with the adjusted torque signals rather than the torque signals which would otherwise be generated. This has the result of returning the web to an adjusted nominal web path, rather than the actual nominal path.

The present invention also provides a method for controlling tension in a movable web. The method includes the steps of supporting a supply roll from which the web may be drawn, defining a nominal web path, and locating the web along the nominal path. Displacement of the web from the nominal path is measured, and a signal is generated which is representative of the web displacement. In response to the displacement signal, a torque signal is generated to be representative of a torque value to be applied to the supply roll to return the web to the nominal path. Torque is applied to the supply roll in accordance with the torque signal.

Accordingly, it is an object of the present invention to provide an apparatus and method for controlling the tension within a movable web; to provide such an apparatus and method which are capable of controlling the web despite frequent accelerations and decelerations within the web; to provide such an apparatus and method which can accommodate continuous or intermittent movement of the web, or complete reversal of web movement; and to provide such an apparatus and method which are capable of compensating for changes in supply roll diameter and other changes in operating conditions.

Other objects and advantages of the invention will be apparent from the following description, the accompanying drawings and the appended claims.

BRIEF DESCRIPTION OF THE DRAWINGS

FIGS. 5A, 5B and 5C together comprise FIG. 5, which is a schematic diagram of a further portion of the control system of FIG. 3;

DETAILED DESCRIPTION OF THE PREFERRED EMBODIMENTS

Figure 1:
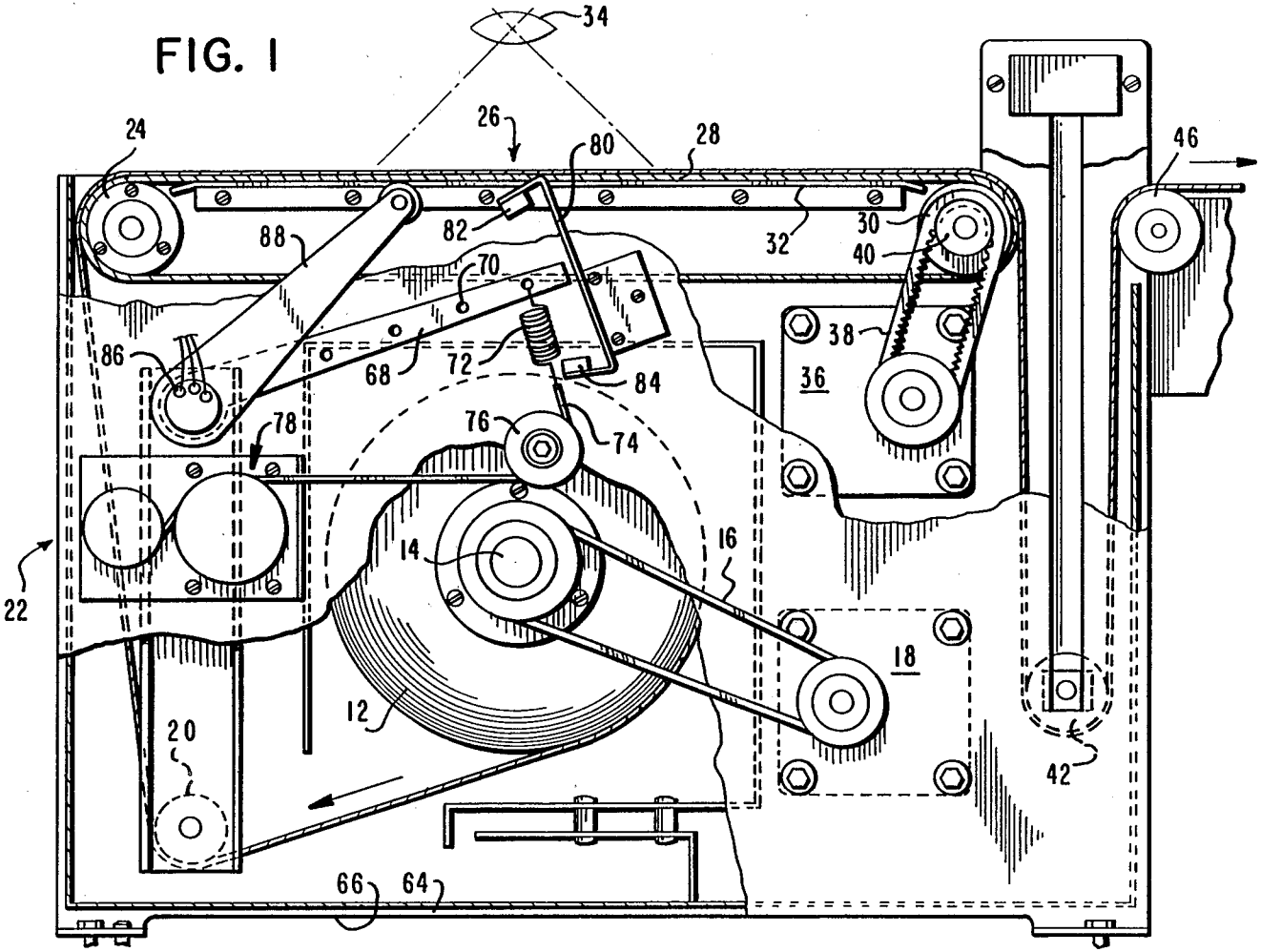
FIG. 1 is a side view of a web handling apparatus incorporating an apparatus for controlling tension within a movable web in accordance with the present invention.

Web-handling apparatus with which the photosensitive media can be used, and which incorporates the web tensioning apparatus of the present invention, can be seen by reference to FIG. 1. Photosensitive web material 10 is provided in a supply roll 12. Further details regarding the web material can be found by reference to U.S. Pat. Nos. 4,440,846 and 4,399,209, which are hereby incorporated by reference. For purposes of this description, it is sufficient to note that the web material has applied to its surface a layer of microcapsules, each microcapsule containing a photohardenable material therein. The material is exposed to light containing image information at a first station. The exposed portion is then transported to a later, second station where the image is developed by passing the web through the nip of pressure rollers. This developing ruptures the microcapsules, releasing the contents of those which were not hardened by exposure. The released material serves to form the visible image.

Supply roll 12 of the web material is supported on a shaft 14 for rotation. Shaft 14 is connected through a drive belt 16 to a torque motor 18 which provides a driving torque to roll 12 in accordance with a control signal supplied to motor 18. After leaving roll 12, web 10 passes around a dancer roll 20 which is urged by appropriate spring means 22 to apply a tension to web 10.

Web 10 is next turned around a roll 24 and directed into the exposure station 26. Within exposure station 26, web 10 is supported by a belt 28 which extends between roll 24 and a second roll 30. A platen 32 is located beneath the belt 28 so that web 10 is firmly supported. A lens 34 or other appropriate imaging system is included for projecting image information onto the web in the exposure station. During such time as exposure is made, the web is stationary on platen 32.

Belt 28 and hence web 10 is driven at the exposure station by a motor 36, which is in turn connected to a toothed drive belt 38 passing around a toothed pulley 40 mounted at one end of roller 30. Motor 36, operated by an appropriate motor control (not shown), is capable of executing a precise number of increments of rotation for each incremental advance of web 10 between exposures. Motor 26 may be any appropriate motor for this purpose. In one working embodiment, in which the web is to be advanced approximately 12 inches between exposures, a one-fifth pitch timing belt 38 having 20 teeth can be used. The output drive pulley on motor 36 is selected so that three revolutions causes one full cycle of the belt.

As web 10 leaves the exposure station, the web is placed under tension by a dancer roll 42. Dancer roll 42 may be spring loaded by an appropriate spring means (not shown) so as to provide sufficient downward force to the web. Further details regarding the dancer roll 42 and its construction may be seen by reference to copending application Ser. No. 39,879, filed April 20, 1987. While the construction shown therein is preferred for this apparatus, any appropriate dancer roll construction may be used.

After passing around dancer roll 42, web 10 is directed to a guide roll 46, whereafter web 10 extends to a developer station (not shown). The specific details of the developer station are unimportant for purposes of this invention. However, details regarding one appropriate developer station can be seen by reference to copending application Ser. No. 039,393 filed April 16, 1987. It is sufficient to note that the developer station is preferably a pair of driven pressure rolls, with the web passing through the nip formed by the rolls. The rolls are preferably driven at a constant rate, although their direction may be reversed as necessary.

Figure 2:
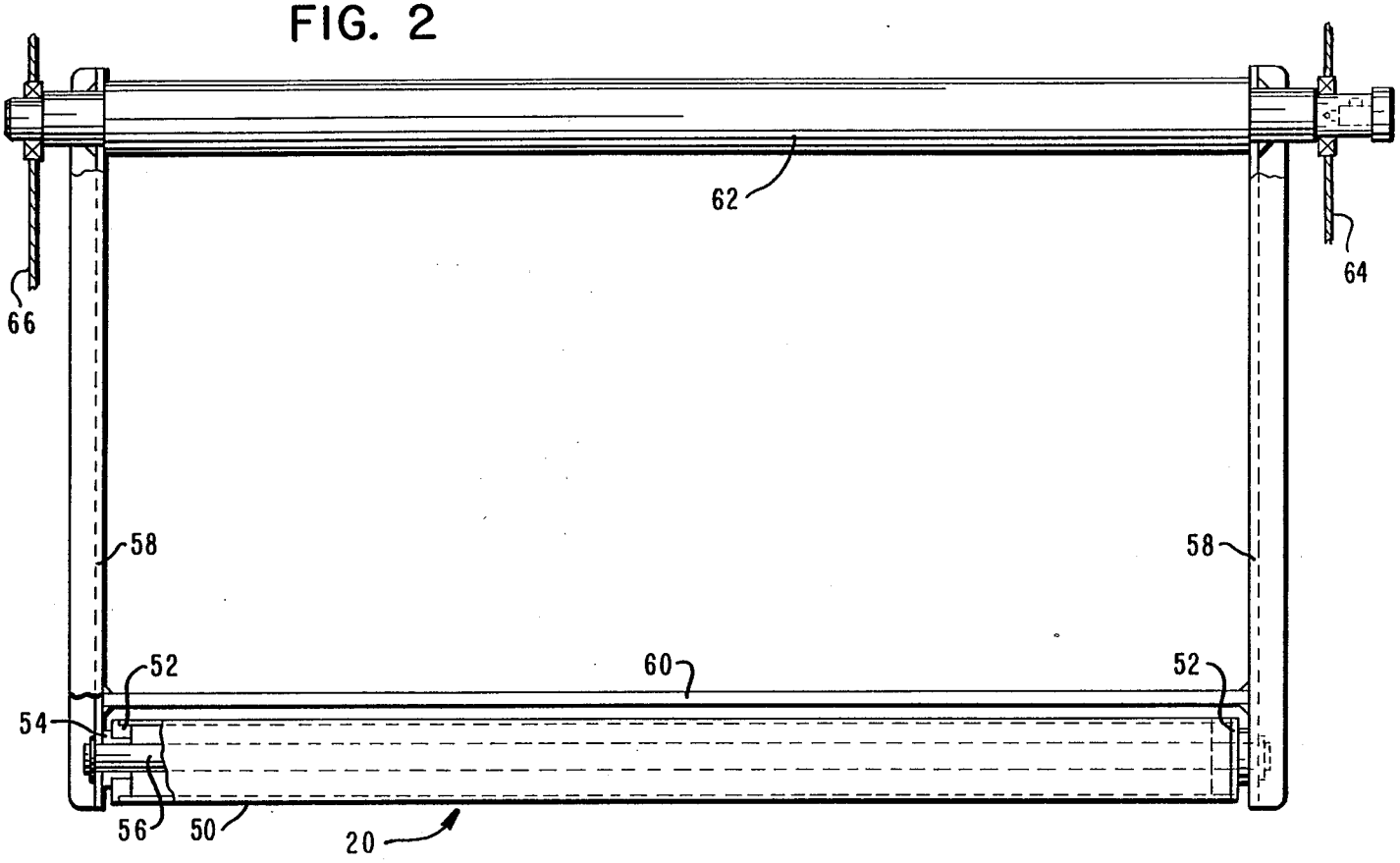
FIG. 2 is a view taken generally along line 2—2 of FIG. 1.

Dancer roll 20 and its support assembly can be seen in greater detail by reference to FIG. 2. Roll 20 includes an outer shell 50 having end caps 52 fitted into each end thereof. Caps 52 are in turn supported on appropriate bearings 54 which are positioned on a roll supporting shaft 56.

Shaft 56 is connected between dancer arms 58. Arms 58 are interconnected by a cross member 60 located near roll 20, and an arm support shaft 62 which is fixedly connected to arms 58 at their upper ends. Thus, the entire assembly can be pivoted about the axis of shaft 62.

Support shaft 62 extends between side frames 64 and 66, and is appropriately journalled within each side frame for rotation. Referring back to FIG. 1, shaft 62 is further fixedly attached to lever arm 68, which pivots in response to pivotal movement of dancer roll 20 and arms 58. A plurality of holes 70 are provided along the length of arm 68, and connected to one hole 70 is a buffer spring 72 which is connected to a cable 74. Cable 74 passes around a pulley 76 and is connected to a spring motor 78 which exerts a constant pulling force on cable 74 to move arm 68 pivotally in a downward direction. A stop bracket 80 is connected to side frame 64, and includes stop pads 82 and 84, which limit the motion of arm 68, and hence the pivotal motion of dancer roll 20. When dancer roll 20 is in its normal position (shown in FIG. 1), arm 68 should occupy a position approximately midway between stop pads 82 and 84. Additional holes 70 are provided along the length of arm 68, to enable the pulling force exerted by spring motor 78 and the nominal tension in the web to be adjusted.

It will be noted that dancer roll 20, as result of spring motor 78 acting on arm 68, will be urged outwardly with respect to the web. The nominal web tension is thus set by the force exerted by the spring motor 78 acting on the web through arm 68. Spring motor 78 is selected to exert constant force, and the force exerted on the web is relatively constant so long as arm 68 does not hit stops 82 or 84. If the web is payed out from the supply roll too quickly or rewound too slowly, spring motor 78 will cause dancer roll 20 to move outwardly with respect to the web, thereby moving arm 68 toward stop 82. If the web is payed out too slowly or rewound too quickly, dancer roll 20 will move inwardly with respect to the web, moving arm 68 toward stop 84.

When arm 68 is in its centered position, the web is located within a nominal position along a nominal web path. Movement of arm 68 moves the web from this nominal path, with the degree of web displacement reflected by the displacement of arm 68.

Connected to one end of support shaft 62 is the shaft of a potentiometer 86. The body of potentiometer 86 is in turn connected to support arm 88, which is in turn secured to side frame 64. It will therefore be seen that rotation of shaft 62 will cause the resistance value of potentiometer 86 to change. Thus, the position of dancer roll 20, as well as the position of the web, will be directly related to the resistance value of potentiometer 86.

The present invention operates to control the web by controlling the torque applied to supply roll 12. Potentiometer 86 detects the position of the web and arm 68, generates a signal representative of web displacement, and a servo system responsive to such signal controls the torque to maintain the arm about its nominal position. The force on the web from the roll balances the varying force on the web from the web transport maintaining a constant force on the web from dancer roll 20 and constant web tension. The web may therefore be simply pulled into or pushed out of the supply roll while constant tension is maintained in the web.

Figure 3:
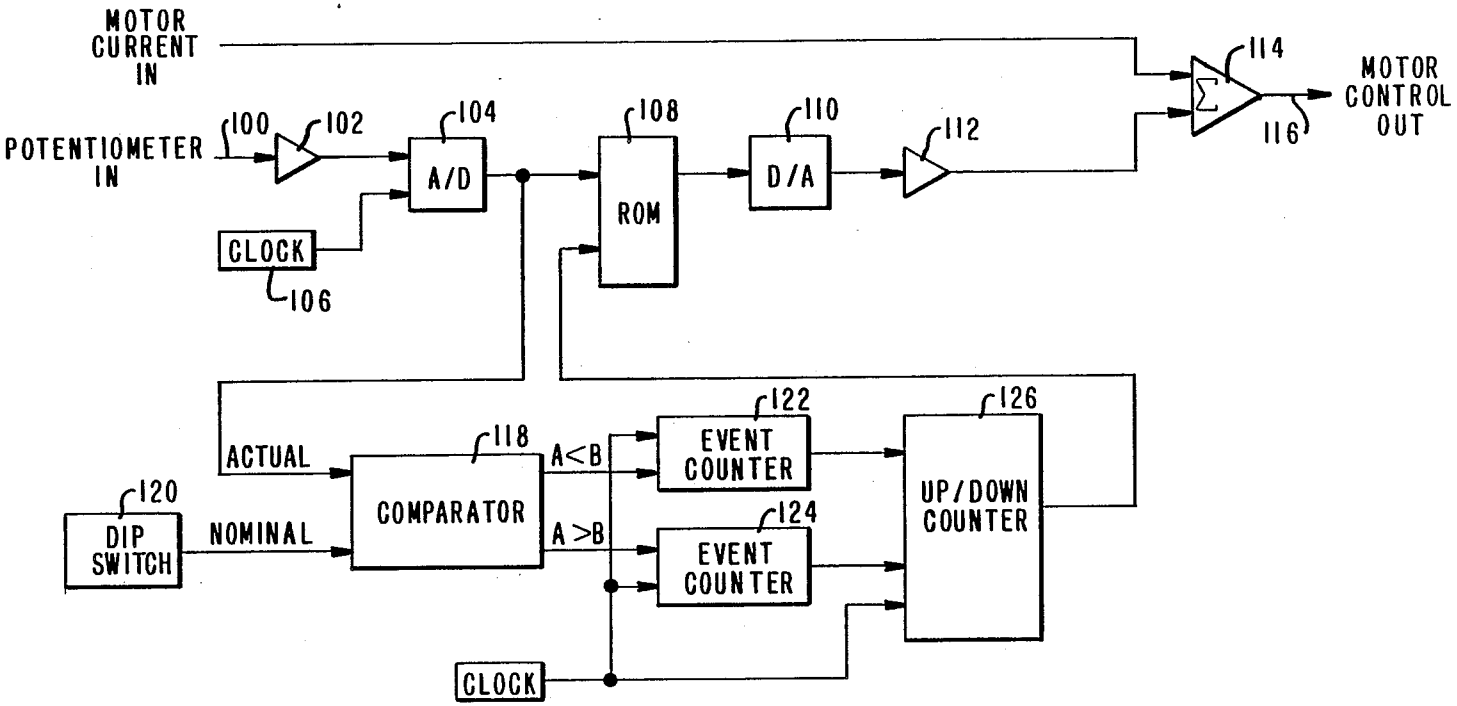
FIG. 3 is a block diagram of a control system for the apparatus.

One form of a control means for the web tensioning apparatus can be seen in block diagram form by reference to FIG. 3. Input from potentiometer 88 is applied at 100. This signal is passed through appropriate buffering and scaling means 102, whereafter the signal is supplied to an analog-to-digital converter 104. Converter 104 is triggered by a clock 106, whereupon the input analog signal is converted to a digital output and directed to a read only memory (ROM) 108.

Because the digital value input to memory 108 is representative of the position of dancer arm with respect to the web as measured y the potentiometer, the value is used to address memory 108 to locate a value representative of the torque which must be applied to the web supply roll to return the web and dancer roll 20 to the nominal position. Once this value has been selected, it is output to a digital-to-analog converter 110. The analog signal is buffered and scaled through appropriate means 112, whereupon it is directed to a summing amplifier 114. There, the signal is summed with the torque motor control current, with the resulting output being directed to the torque motor 18 (FIG. 1) at 116.

For any given input potentiometer value, a single unique torque motor control value can be output with satisfactory results. In such a case, a one-to-one correspondence within the look-up table held within memory 108 can be used. However, better control over the web can be obtained if the output motor control is made dependent upon other values within the web handling system. For example, the diameter of the supply roll affects the torque which should be applied to the roll, and as the media is used, the diameter of the roll continuously decreases. Alternatively, if the system is operated in a reverse direction, the roll diameter increases.

A further example where one-to-one correspondence between input and output values may not be desirable is during startup of the system. In such a case, little tension will be present within the web, and a large amount of torque could be applied to the supply roll. However, this rapid application of large torque could damage the web. Accordingly, in such a case, a lower torque value than otherwise indicated would be applied until the web has been brought under normal tension and dancer roll 20 has reached its nominal position.

To accommodate such situations, multiple tables are stored within memory 108 such that a given input value can address one of a plurality of output values, depending upon the particular table from which the system is currently operating. The means by which the various tables are selected can be seen by reference again to the block diagram of FIG. 3.

After a digital position value is output from analog-to-digital converter 104, it is applied to a comparator 118. At the same time, a value corresponding to the nominal position is applied to comparator 118 from an appropriate input. In the example shown herein, this input is DIP switch 120, so that the nominal value can be adjusted in accordance with the configuration and characteristics of the specific system. Comparator 118 determines which of the two values is greater, and increments the appropriate one of event counters 122 and 124. The event counts are supplied to an up/down counter 126, which determines whether the actual value has consistently varied from the nominal value over a predetermined number of clock increments. For example, in the preferred embodiment, if 8 counts are recorded in which the actual value exceeds the nominal value, this will indicate that torque values are being taken from the wrong table. Thus, counter 126 will change the table within memory 108 from which torque values are selected. If the results of the comparison made within comparator 118 are relatively balanced, i.e., the requisite number of events registered by counter 122 or 124 does not occur, then it is assumed that the proper table is being consulted. All other operation of the system is as has been described.

Figure 6A:
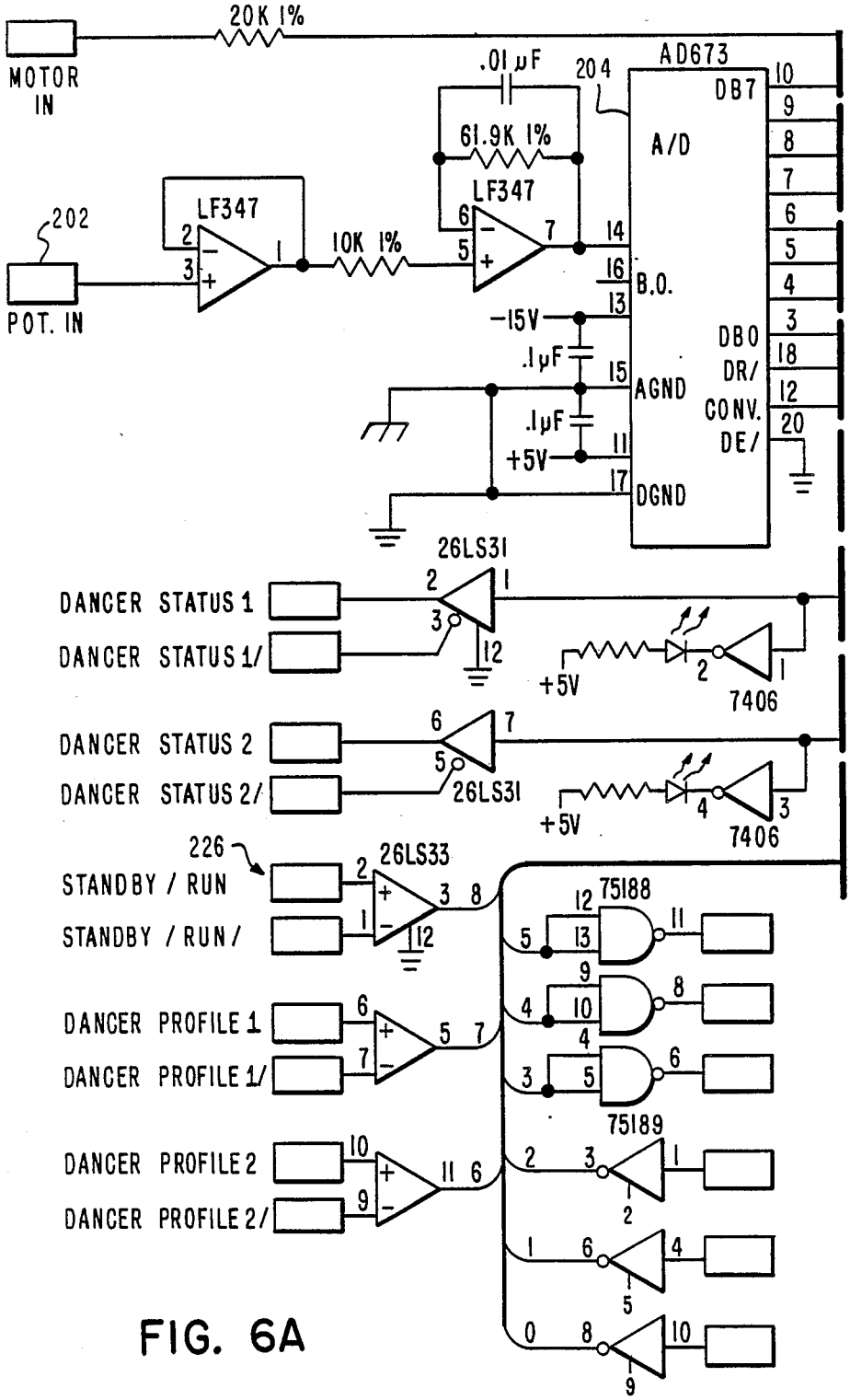
FIGS. 6A, 6B and 6C together comprise FIG. 6, which is a schematic diagram of an alternative control system for use with the present invention.
Figure 6B:
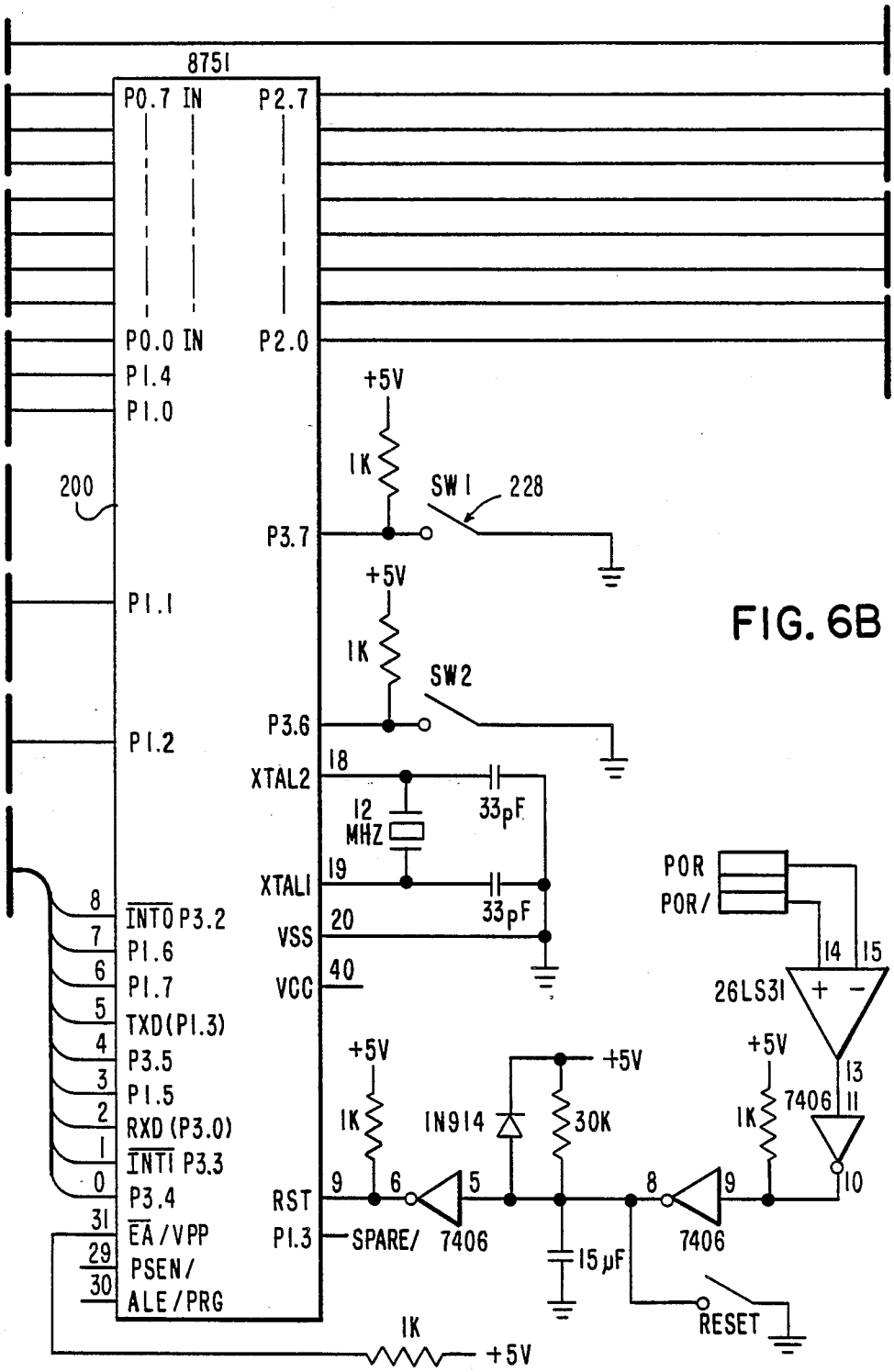
Figures 6, 6C:
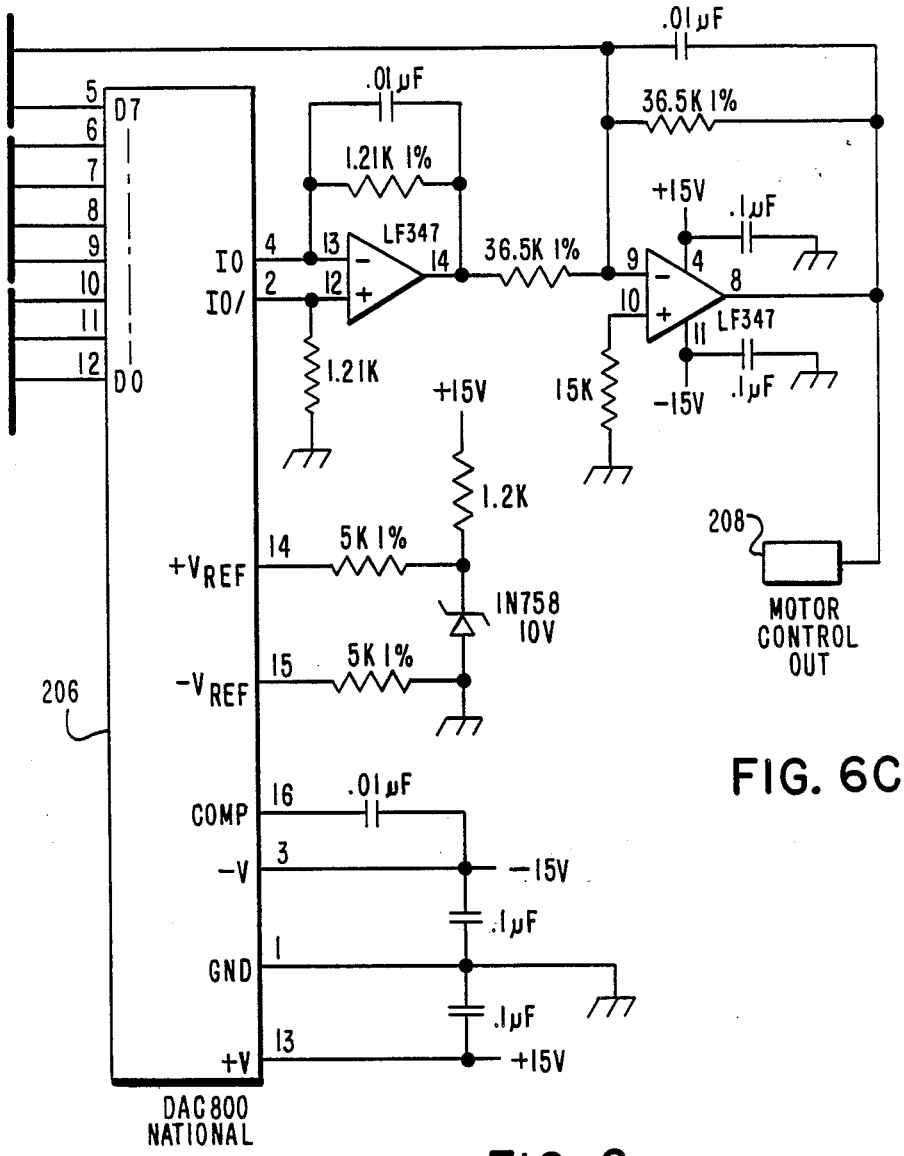

It has been found that the correlation between the input position value and the output torque value can be represented by a linear function. Accordingly, the values stored in memory 108 are determined in accordance with the plots shown in FIG. 6. Thirty-two tables are provided within the memory, with tables 3–32 being defined by parallel straight lines. (Of course, the table values actually represent discrete points along these lines.) In the plots of FIG. 6, the input voltage from the potentiometer and the digital addresses from analog-to-digital converter 104 are shown along the X-axis of the plot, while the output voltage to the torque motor and the digital values supplied to digital to analog converter 110 are shown along the Y-axis. It will be noted that specific values for the voltages are not shown on the plots, since such values are dependent upon the specific components used within the system. Variations in position as determined by the potentiometer will result in changes in output torque along the particular straight line function corresponding to the table presently in use. However, the function will change as the table changes, in accordance with the manner previously described.

It will be noted that lines 1 and 2 corresponding to tables 1 and 2 within memory 108 are not parallel to the remaining lines used in generating the tables. These particular lines are specifically intended for use during startup of the apparatus. Ordinarily, such a high torque would be placed upon the supply roll that the web could be detrimentally affected. Accordingly, the control system is reset upon startup to operate in accordance with the first table, whereupon the amount of torque placed upon the supply roll is relatively small. After the requisite number of clock periods, the second table comes into use, whereupon the amount of torque which can be exerted upon the supply roll is increased. Finally, the system advances to the third table and so forth, whereupon normal operations begin. The effect of beginning operations through the first and second tables is to produce a soft start whereupon the web is gradually brought into its nominal position.

In a like manner, the first and second tables can be used when operation of the system has been completed. This produces a soft shut down of the system, whereby the web is controlled at all times.

After start-up of the system has been completed, a common cause of further changes in tables will be changes in the angular velocity of the supply roll, which in turn can be related to changes in the diameter of the web supply roll. Thus, the particular table in accordance with arm position used by the system at any one time can be an approximate indication of the roll diameter, and can be used to signal the operator when the roll is about to be depleted, whether sufficient web is available for a particular operation, or for other purposes. As will be readily apparent to those skilled in the art, the control system may be modified to map the table number to a "web remaining" value, which value may be presented to the operator on a visible display means or the like.

It will also be appreciated that changes in the table from which the system is operating can signal other conditions within the system. For example, rapid table changes can indicate a broken web, or a jammed web or other mechanical failure. Table changes can also be related directly to angular velocity of the supply roll.

Figure 4A:
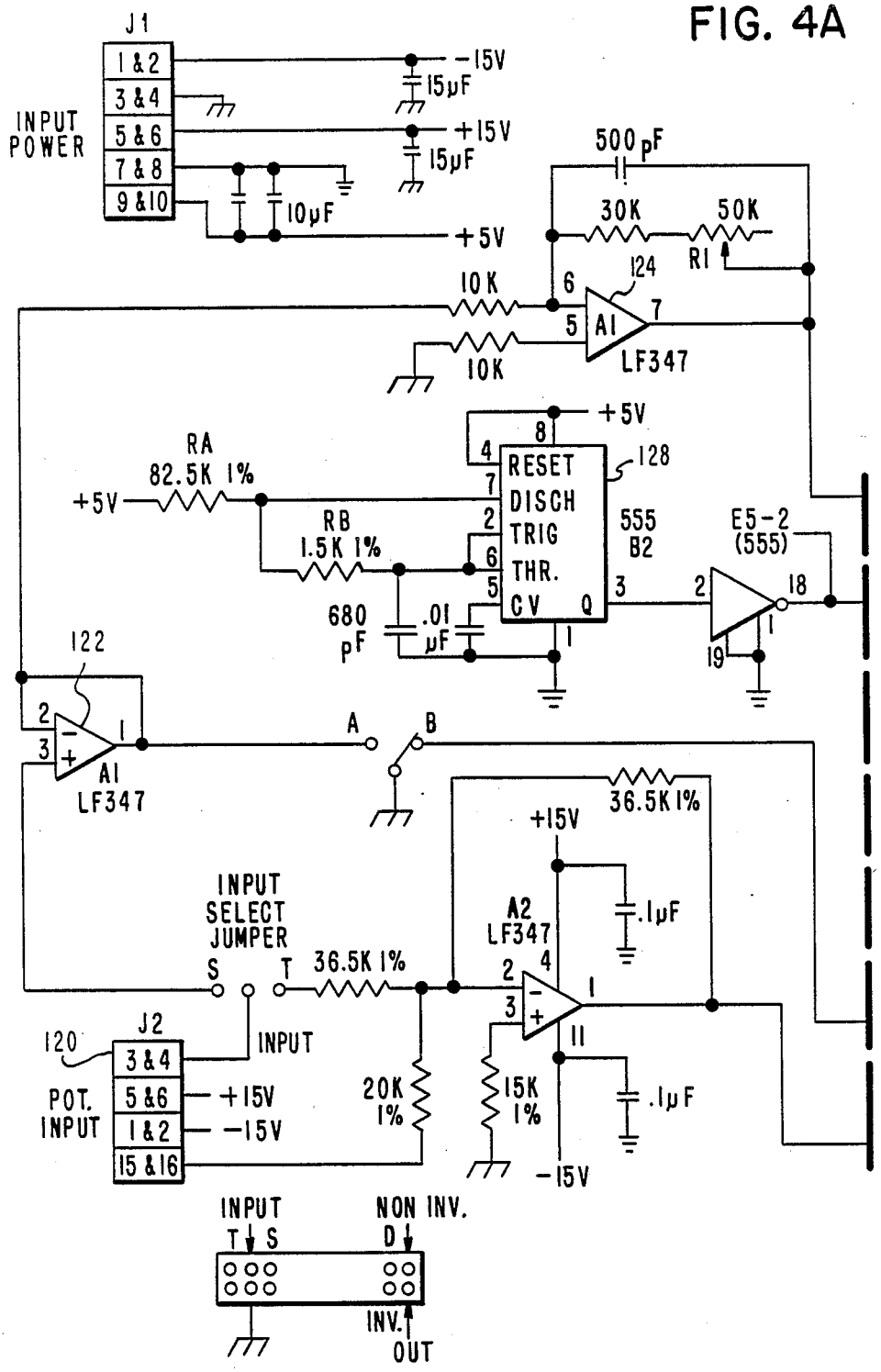
FIGS. 4A, 4B and 4C together comprise FIG. 4, which is a schematic diagram of a portion of the control system of FIG. 3.
Figures 4, 4B:
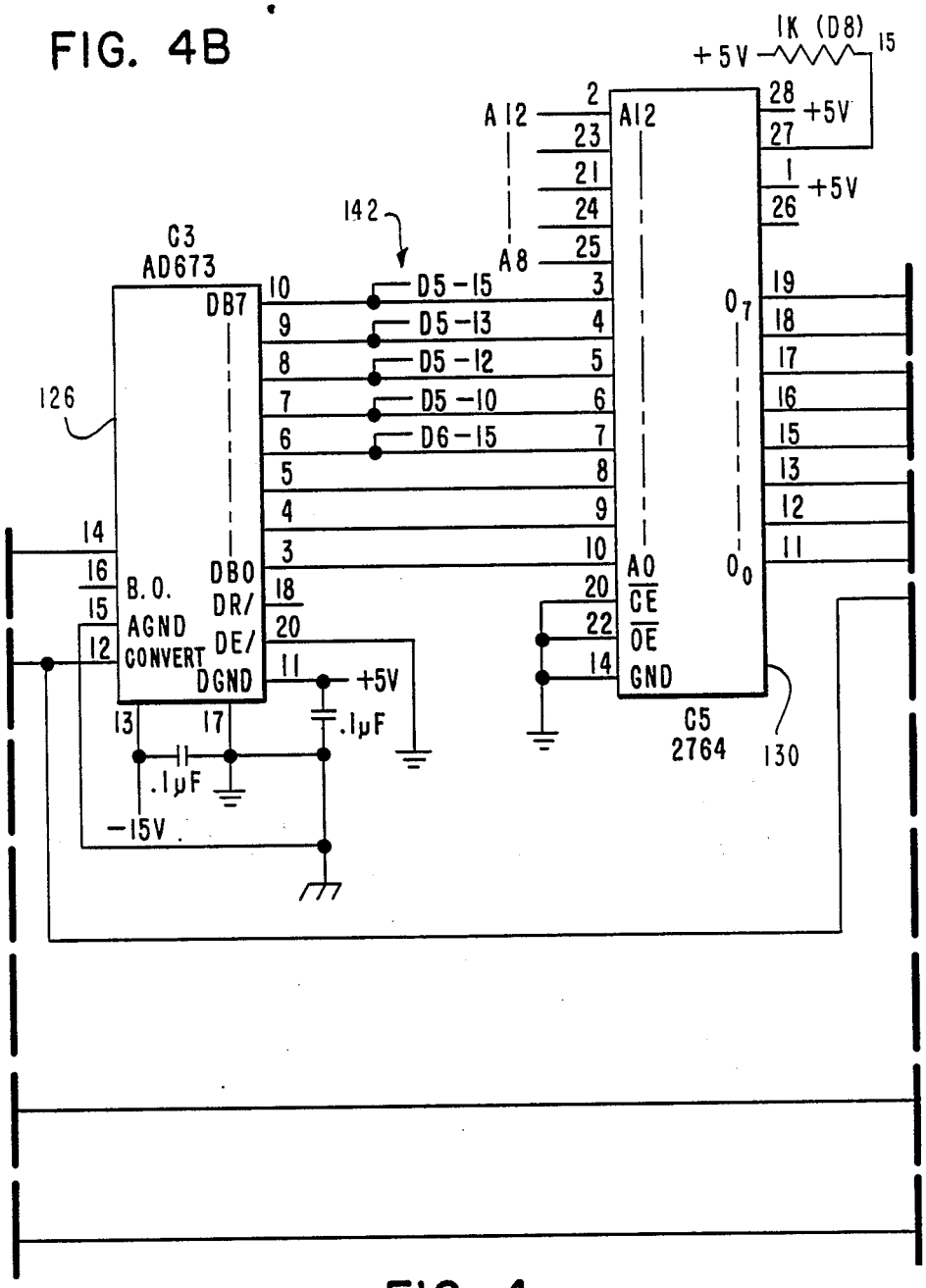
Figure 4C:
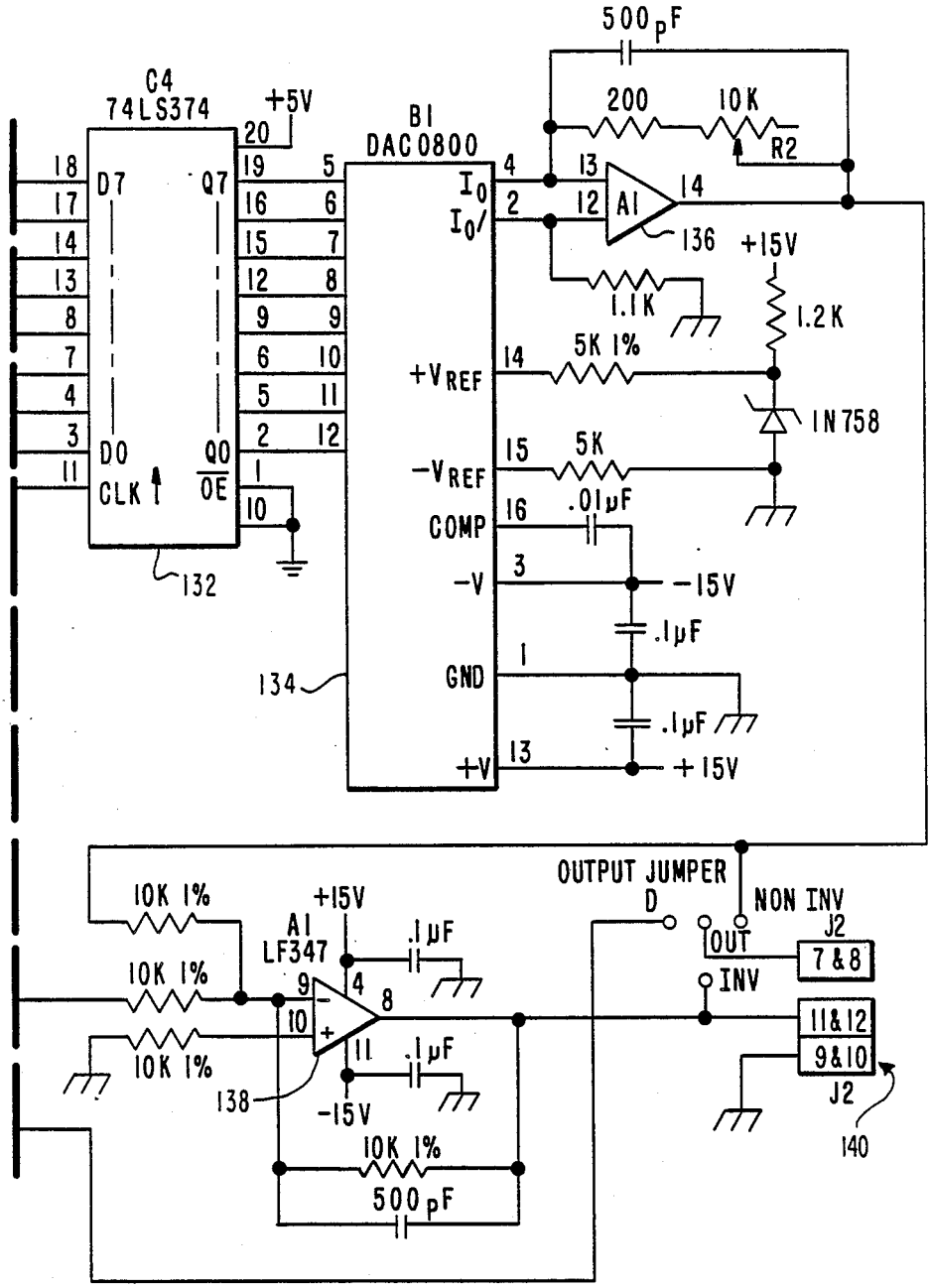
Figure 5B:
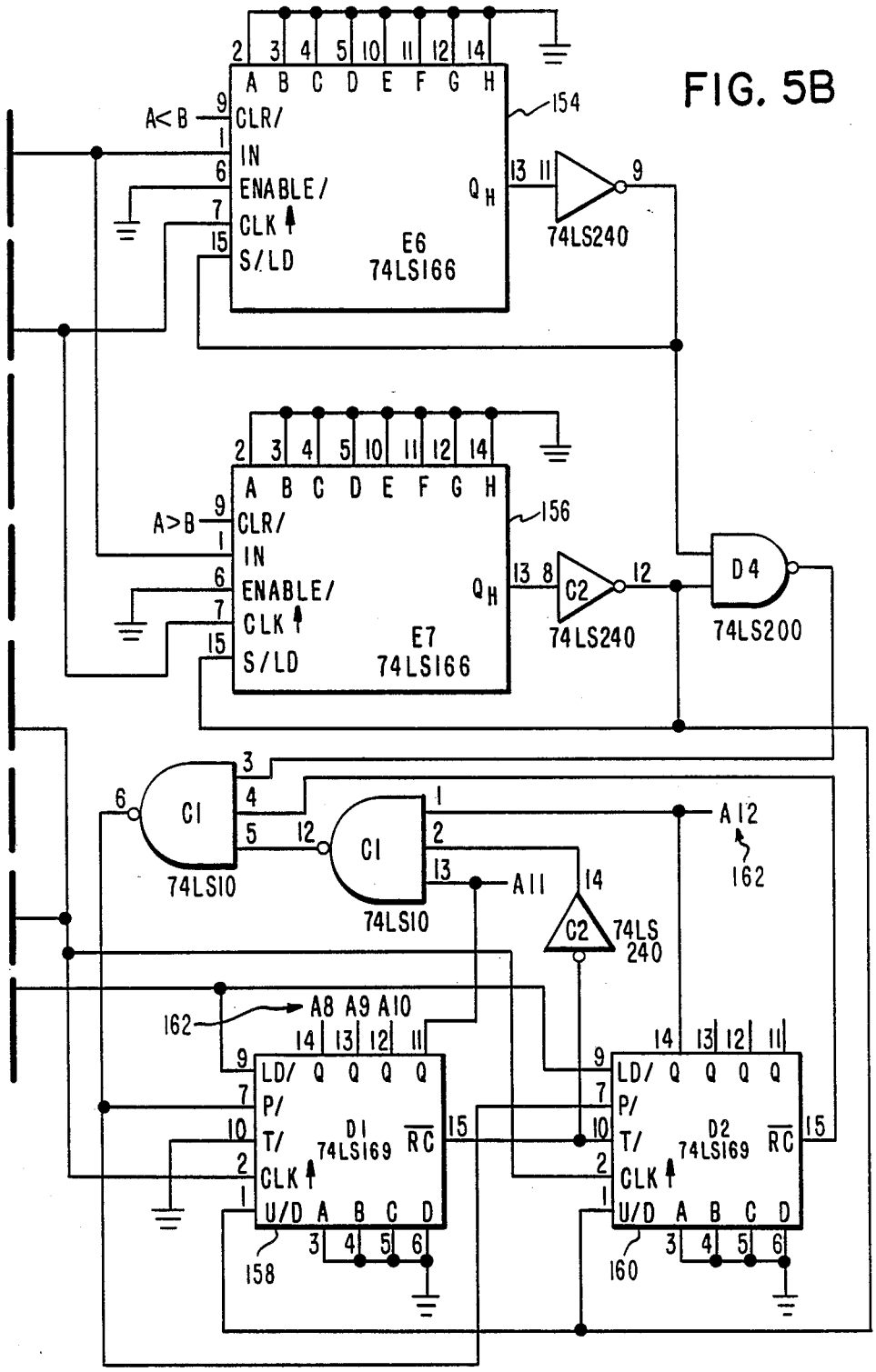
Figure 5C:
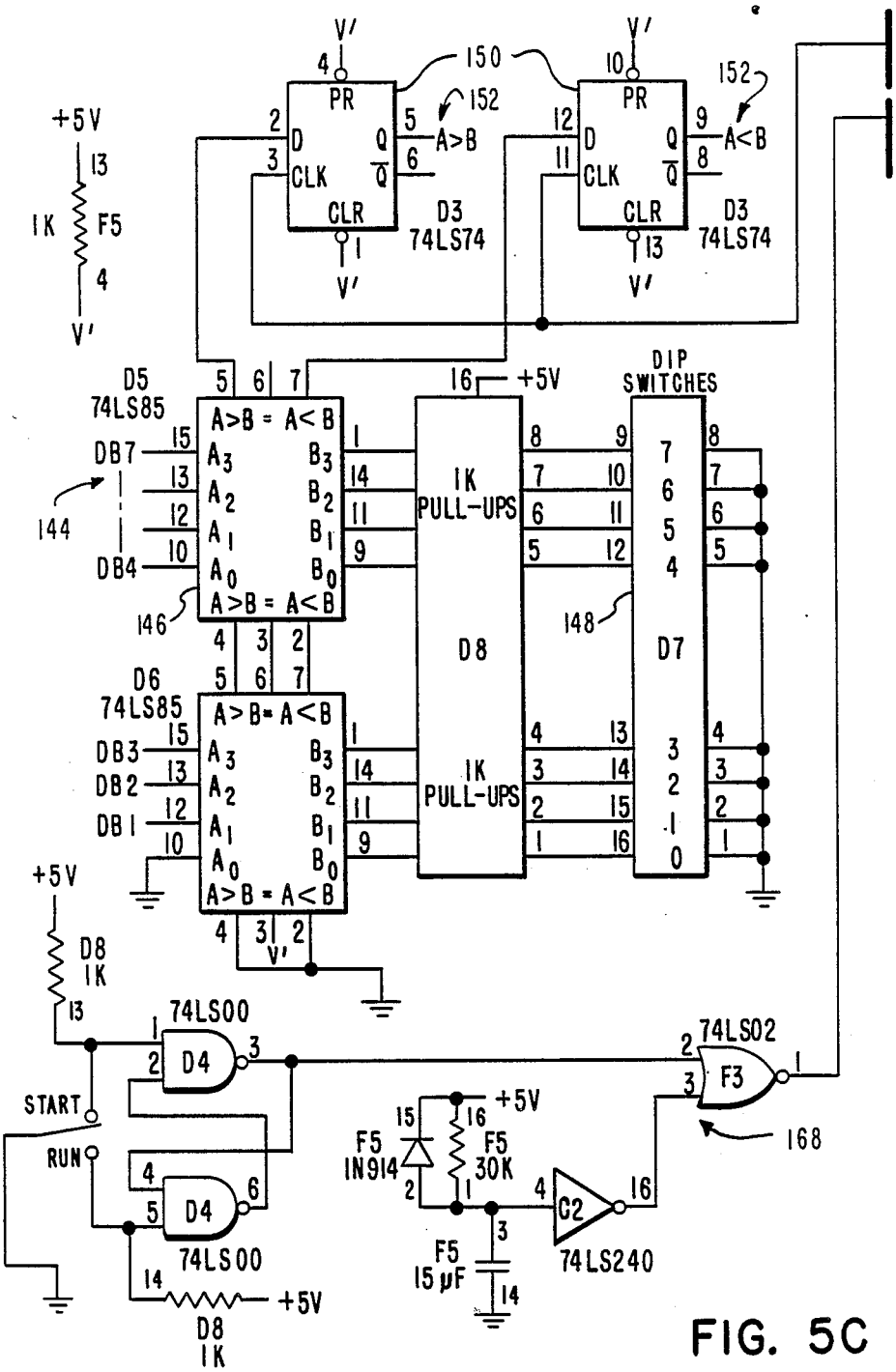

Further details of the control system shown in the block diagram of FIG. 3 can be seen by reference to FIGS. 4 and 5. The major components will be identified herein, although the specific detailed operation of the circuits shown in FIGS. 4 and 5 will be understood by those skilled in the art, particularly with reference to FIG. 3 and the accompanying description.

As shown in FIG. 4, the potentiometer center tap is input at 120. This input passes through a buffer amp 122 and scaler amp 124, before reaching analog-to-digital converter 126. Converter 126 is preferably an AD673 converter commercially available from Analog Devices Inc. The necessary clock input to converter 126 is provided by a 555 timer 128.

The digital output from converter 126 is supplied to PROM 130, which serves as the system memory and is preferably a 2764 device available from Intel Corp. The various motor output energization values are stored within PROM 130, with the output signals being supplied through a latch 132, which is preferably a 74LS374, commercially available from Motorola Inc. The latch output is in turn supplied to digital-to-analog converter 134, preferably a DAC0800 device available from National Semiconductor Corp. The converter output passes through scaler amp 136 and buffer amp 138 for output to the torque motor at 140.

As has been described, output from analog-to-digital converter 126 is also used to select the proper table within PROM 130. These outputs, shown in FIG. 4 at 142, connect with the circuit shown in FIG. 5. Such inputs are applied at 144 to comparator 146, which is preferably a 74LS85 device available from Texas Instruments. The nominal position value is set by means of DIP switches 148. Comparator 146 determines the directional difference between the actual and nominal position values, with output from the comparator being directed to synchronization means 150, which is preferably two 74LS74 devices available from Texas Instruments. The outputs from the synchronization devices, indicated generally at 152, are applied to shift registers 154 and 156, each of which is preferably a 74LS166 device available from Texas Instruments. The output from these shift registers is applied to counters 158 and 160, both preferably 74LS169 devices from Texas Instruments, which counters determine the specific table which will be accessed within the memory to provide torque motor control output. Such output can be seen generally at 162, and is applied to PROM 130 as shown in FIG. 4 at 164.

Further referring to FIG. 5, a clock circuit can be seen generally at 166, which circuit is used to trigger the shift registers and counters for table selection. Finally, a power-up reset circuit can be seen at 168. The output from such circuit is applied to counters 158 and 160 upon startup of the web-handling apparatus, so that the initial table used to achieve a soft start will always be selected at startup.

It should be recognized from the foregoing description that torque motor 18 (FIG. 1) coupled to supply roll 12 will operate in either direction, depending upon the direction in which web position at dancer roll 20 varies from the nominal position. As a result, the system described herein will operate to maintain tension in the web regardless of whether the web is moving in the forward direction, i.e., to pay out the web from supply roll 12, or in a reverse direction, in which case the web is wound onto supply roll 12. In either case, the operation of the web tension control system is the same.

In some systems, it may be helpful to minimize system tracking, particularly when the web is not being moved. A small change in arm position may cause the system to adjust the torque applied to the supply roll, causing further change in arm position, which again causes a change in torque, and so forth. Such effect can be reduced by direct feedback, wherein the input signal to the control system is applied directly to the control system output to smooth the output signal. Other approaches which can be used include a programmed deadband within the tables about the zero torque region, adjustments in nominal tension in the web, and low torque gain around the centered dancer roll position. Further, a predetermined number of least significant bits can be dropped to prevent unwanted movement; the time interval within which the system is updated can also be lengthened.

It will be recognized that other approaches may be used to correlate the measured web position values to torque values to be applied to the supply roll. In one example, the torque values may be expressed as a mathematical function of the input position values, in which case, output torque is calculated rather than simply mapped. Such a control system can be designed to utilize a microprocessor rather than a memory. Better control can be obtained through use of multiple functions, with the proper function being selected in a manner similar to that used for selecting a proper table. Alternatively, a single function can be devised having multiple variables, with a second variable effectively adjusting the function. In any case, the measured position values are used to adjust torque using the web handling apparatus previously described herein.

Figure 7:
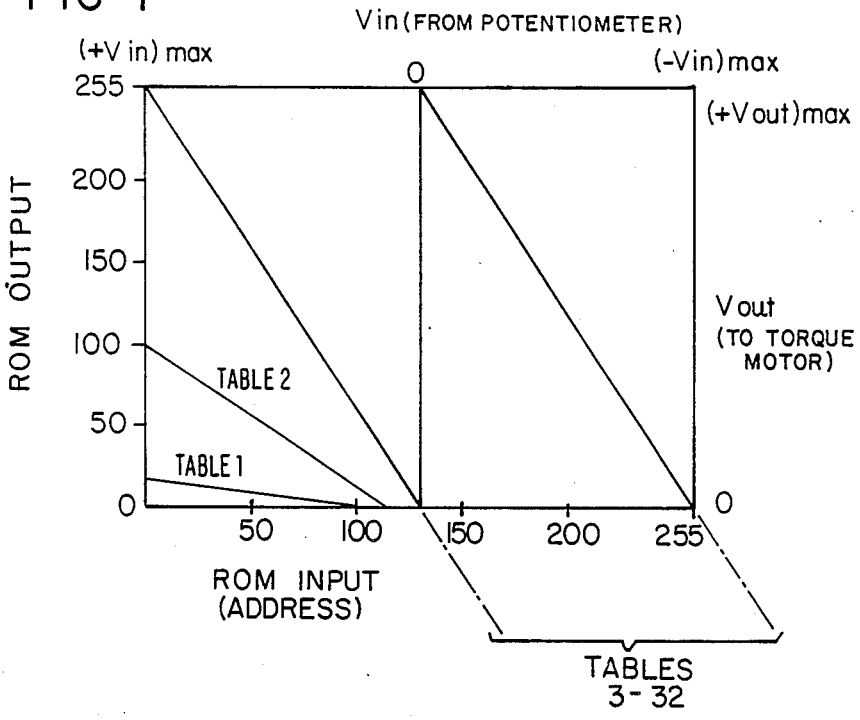
FIG. 7 is a plot illustrating the relationship between web position values and output torque values as used by the control system of FIGS. 3–5.

A preferred control system for the apparatus of the present invention, which operates by calculating the torque values from dancer roll position, can be seen by reference to FIG. 7. The control system of this embodiment is based upon microprocessor 200, preferably an 8751 processor commercially available from Intel Corp. Input from the potentiometer is applied at 202, and after amplification and scaling, is directed to analog-to-digital converter 204. The 8-bit output from converter 204 is supplied to microprocessor 200. The 8-bit output from the microprocessor is directed to digital-to-analog converter 206, with the analog output being buffered, scaled, and summed with the motor control current to provide a torque motor control output at 208. A variety of inputs 210 to processor 200 are provided to enable operating parameters for the system to be defined. Several outputs 212 are provided to enable system status to be displayed. Further, a serial link at 214 can be used to provide other, more precise inputs and outputs for processor 200.

Figure 8:
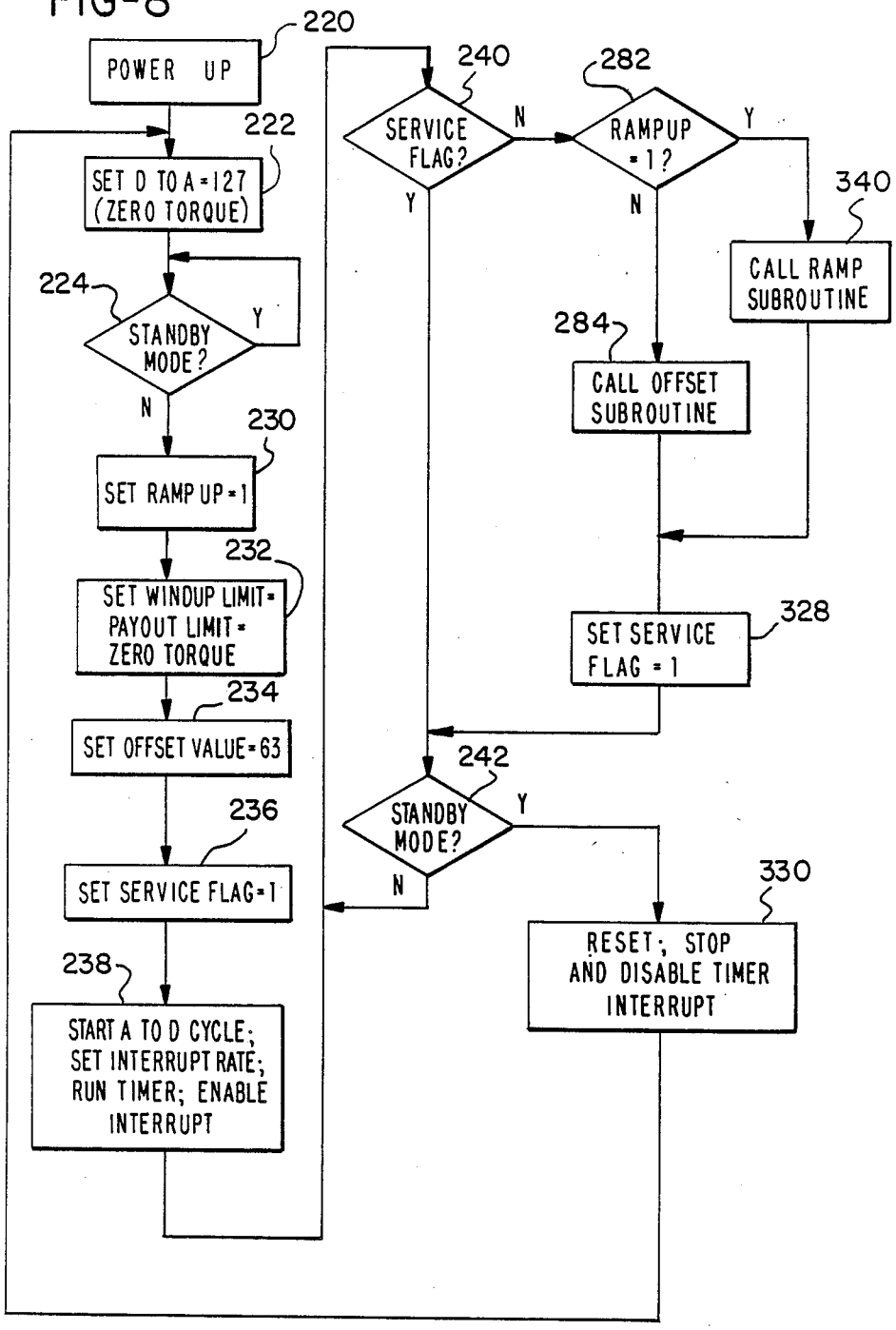
FIGS. 8–12 are flowchart diagrams illustrating the operation of the program used by the control system of FIG. 6.

The control system of FIG. 6 operates in accordance with the program for microprocessor 200 shown in FIG. 8. In simple terms, the program operates to receive a position value for the dancer arm assembly, and calculate from such value the necessary torque which must be applied to the supply roll to control tension in the web. The calculation is made on the basis of a series of related linear functions, with the specific function being selected on the basis of the past behavior of the dancer arm assembly.

As shown in FIG. 8, the control system is initially powered at block 220. At block 222, the value (DTOA) being output to the digital-to-analog converter is set to cause zero torque to be applied to the roll. In the present system, torque can be applied to the roll in either rotational direction, since the system is designed both to pay out and wind up the media. If a similar response is desired for either direction of web movement, the zero torque value is defined to correspond to the midpoint of the available output range for DTOA. The 8-bit value can range from zero to 255, and the zero torque valve is thus set at 127. It should be recognized, however, that in some systems it may be desirable to enable greater torque to be applied in one direction than the other, thereby biasing the system in one direction, in which case some value other than 127 may be used to represent zero torque. This might be required, for example, where a system is intended primarily for paying out web or primarily for taking up web.

At block 224, the program inquires as to whether the apparatus has been placed in a stand-by mode. Such a selection can be made by a logic input applied to the microprocessor at 226 (FIG. 6A), or manually through switch 228 (FIG. 6B). If a stand-by condition is noted, the stand-by inquiry is simply repeated until the apparatus has been placed in its run mode.

In many instances upon start-up, the dancer roll may be at the limit of its movement range, most often fully extended. Such a position would result in a large torque being applied to the web supply roll, with the potential for damaging the web and/or apparatus. Accordingly, the program is designed to slowly bring the web under tension. This ramping effect of the torque value is enabled by setting a ramp-up flag at block 230. Further, maximum wind-up limit and pay-out limit values are established, based upon the history of the torque values output by the control system. Initially, these limit values are both set at the zero torque value, and are gradually increased or decreased, as will be described below, to permit torque to be applied to the roll in a ramped manner. During operation of the system, should a torque valve be calculated which exceeds either limit, the limit value will be substituted for the calculated value. Such limits are set at block 232 to initially equal the zero torque value.

To enable fine control over the web, a plurality of functions are used by the microprocessor to relate dancer roll position to the output torque values. The specific linear function in use is defined by an "offset" value, which value, as will be explained in greater detail below, the offset value has a range of zero to 127, and the initial offset value is selected simply at the midpoint of this range, or 63.

At block 236, a service flag is set, for reasons which will become apparent below.

The torque value output from processor 200 to digital-to-analog converter 206 is updated periodically by means of an interrupt routine. Such routine is initialized in block 238, wherein the interrupt rate is set at 180 microseconds, the interrupt timer is started, and the interrupt routine is enabled.

The program now enters a loop to await the update of the torque value output. At block 240, an inquiry is made as to whether the service flag has been set. Since this flag was set in block 236, the program next proceeds to block 242 where a check is made to determine whether the apparatus has been moved to the stand-by mode. These two blocks are simply repeated until the service flag is deleted.

Figure 9:
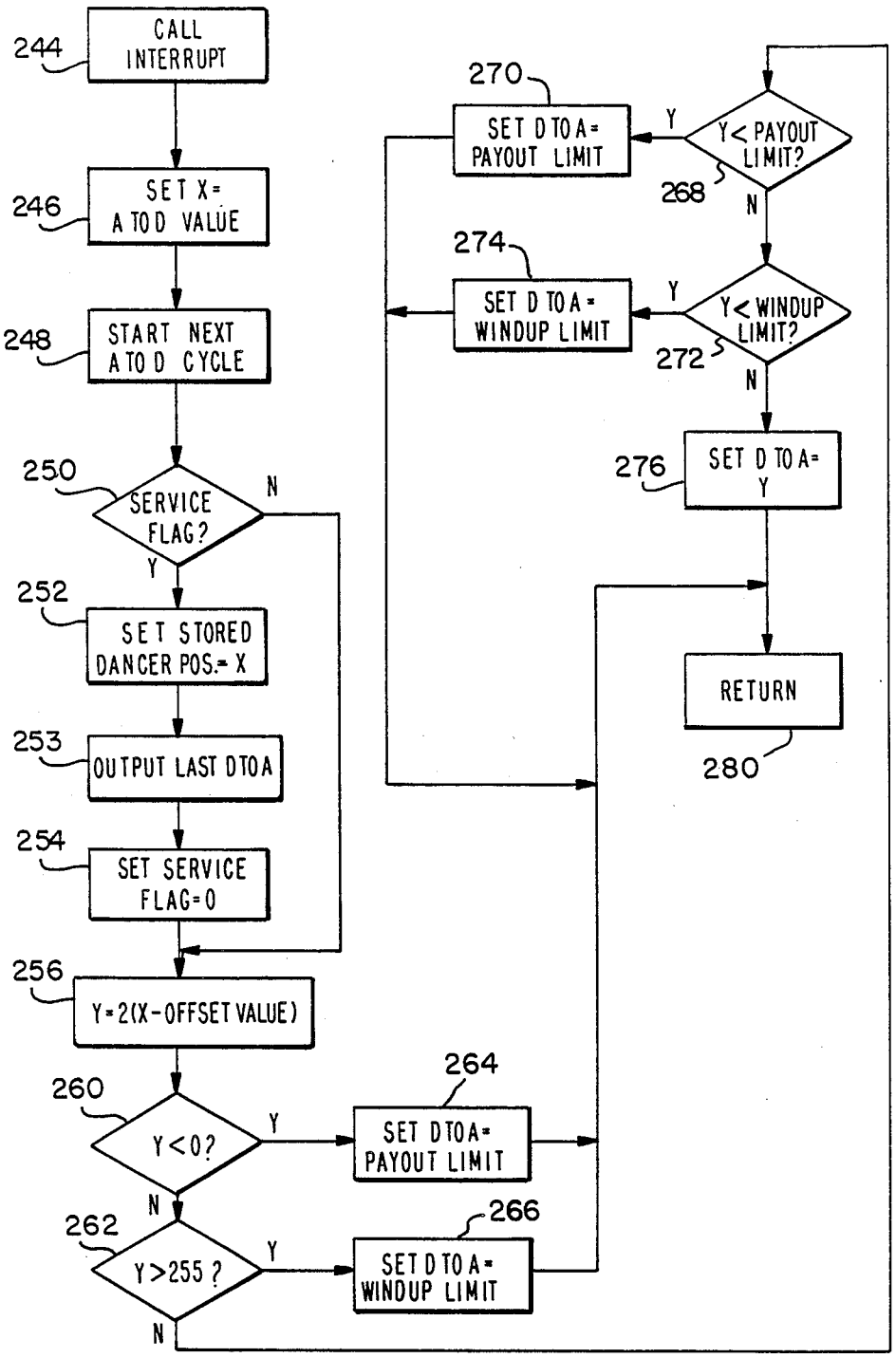

The servo-interrupt routine can be seen by reference to FIG. 9. Upon entry into the routine at block 244, a variable X is set equal to the present ATOD value input from the A-to-D converter and representative of the dancer arm position. The next interrupt timer cycle is started at block 248, and a check is made at block 250 as to whether the service flag is set. With the main program in the loop as previously described, the service flag is set, and the dancer arm position to be stored in the system memory is defined as the ATOD value previously defined as X. The stored DTOA value resulting from the last interrupt routine is applied to the digital-to-analog converter at block 253, and the service flag is reset to zero at block 254. If the service flag had previously been set to zero, blocks 252, 253 and 254 are bypassed. In such a case, the stored dancer position value and output torque value are not updated.

Figure 13:
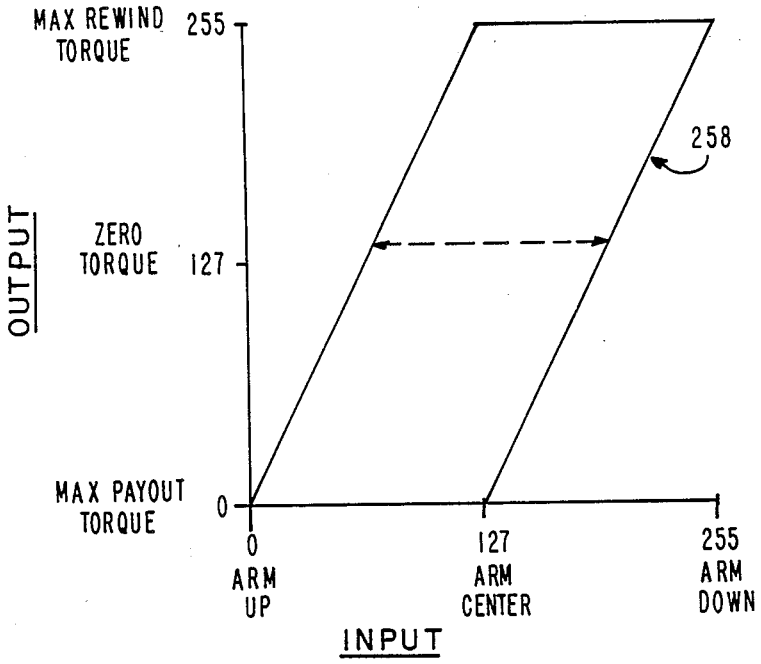
FIG. 13 is a plot illustrating the relationship between web position values and output torque values as used by the control system of FIG. 6.

The calculation of the output torque based on the input dancer arm position is carried out at block 256. Referring to FIG. 13, the linear functions used in calculating the torque value are shown plotted as a function of microprocessor input and output. A series of 128 functions are represented by parallel straight lines contained within the area represented generally at 258. Each line has a slope of 2, and an intercept which is represented by the offset value. Hence, as has been previously noted, the offset value can vary within the range of zero to 127. For the center-most function (offset value $=63$), and for a system balanced between wind-up and pay-out, an input corresponding to a centered dancer arm (input $=127$) will produce a zero torque output (output $=127$).

Returning now to FIG. 9, it can be seen at block 256 that the function set forth will produce a value of Y corresponding to the calculated output. The calculated value is tested, at blocks 260 and 262, to make certain that the value does not exceed the available range in which case the output value DTOA is simply set equal to the appropriate limit value, shown in blocks 264 and 266. Next, the calculated value is compared first with the pay-out limit at block 268, which limit is a minimum value. If the calculated value is less than the limit, DTOA is set equal to the limit at block 270. The routine inquires at block 272 whether the calculated value Y exceeds the wind-up limit. If so, DTOA is set equal to the wind-up limit at block 274. If the calculated value satisfies each of these tests, DTOA is set equal to the calculated value at block 276. At block 280, the processor returns to the point within the main program at which the interrupt routine is called.

Returning now to FIG. 8, and assuming that the interrupt routine was called while the program was within the loop including blocks 240 and 242, it will be seen that upon next encountering the test at block 240, the service flag will be zero. (The flag was set to zero in block 254 of FIG. 9.) The program will move to block 282. Assuming that the ramp-up flag has been cancelled, the program, at block 284, calls the offset subroutine shown in detail in FIG. 10. This routine operates to review the recent history of dancer arm positions to determine whether the function currently used by the processor to calculate torque output should be changed.

Figure 10:
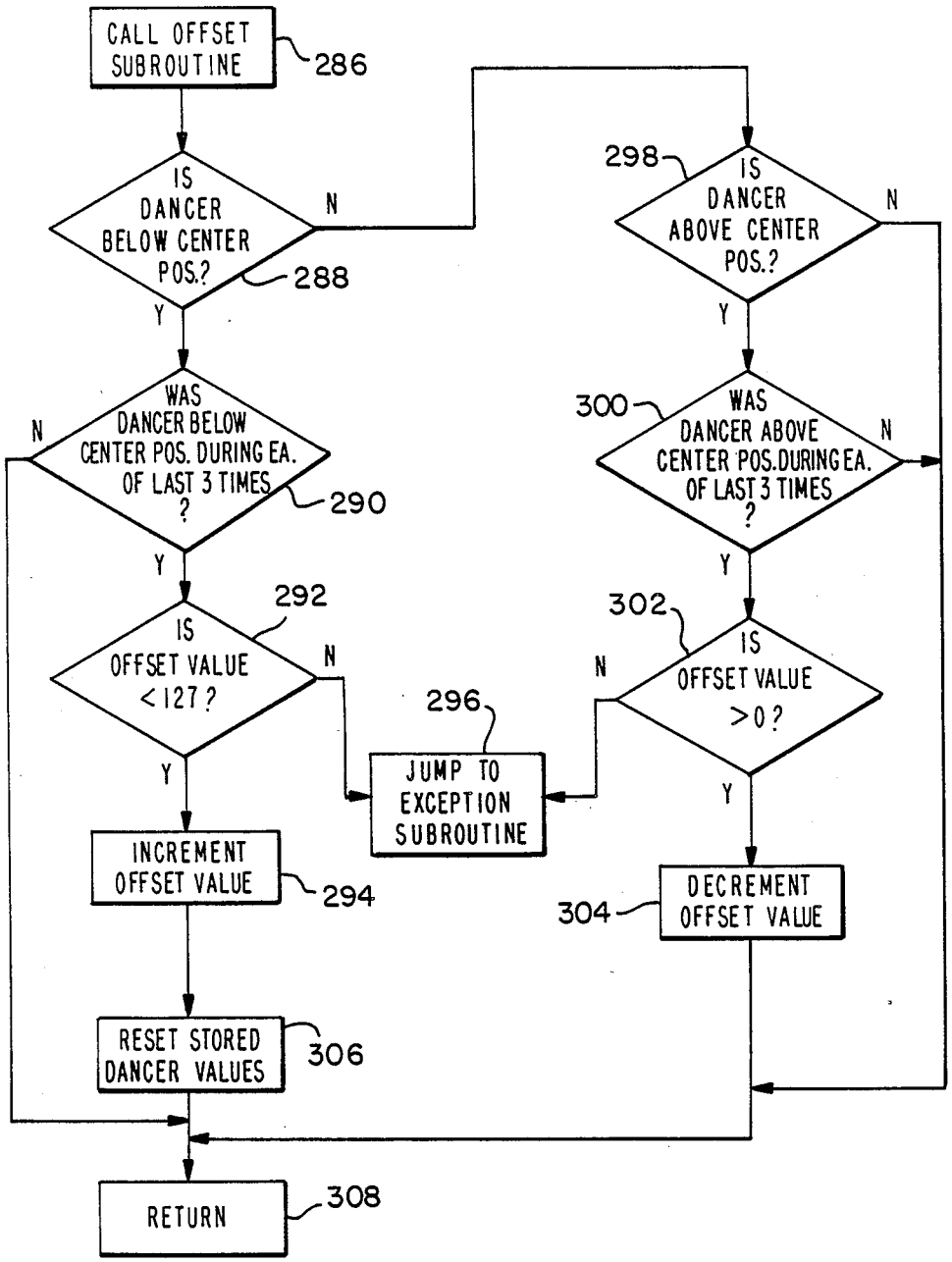

After entering the offset subroutine at block 286 in FIG. 10, the program first inquires whether the current dancer arm position is below its center position. It will be appreciated that if the torque outputs are being selected from the proper function, the dancer arm position should remain generally around center, although it may deviate above and below such position. Thus, if it is determined that the dancer is presently below center position, an inquiry is made at block 290 as to whether the dancer has been below the center position during each of the last three preceding service updates in which a dancer position value was determined. If the dancer has been consistently below the center position during this period, the offset value is assumed to be incorrect for the present operating circumstances. Thus, at block 292, a check is made to determine whether the offset value is less than its maximum value of 127. If so, the offset value is incremented at block 294. If, however, the offset value is at its maximum and a further change is necessary, some problem in the system is indicated, and the program jumps to an exception subroutine at block 296.

Returning to block 288, if the dancer roll is not presently below the center position, a check is made at block 298 as to whether the dancer roll is above the center position. If not, this indicates that the dancer is at the center position, and no change is offset value is needed. If the value is above the center position, a determination is made as to whether the dancer has been above the center position during each of the previous three service updates. If so, and if the offset value is presently above its minimum value of zero, the offset value is decremented at block 304. If the offset value is currently zero, a jump is made to the exception subroutine at block 296.

For any of the alternatives above, the oldest stored dancer value is deleted at block 306, and the next oldest value is now stored as the oldest value, and so forth. A return is made to the main program at block 308.

In FIG. 8, referring back to block 282, if the system has been recently started or reset, the ramp-up flag may be set. (This flag is set upon power up at block 230.) If the flag is set, the program branches to block 340, where the ramp subroutine is called. This subroutine enables the soft start of the system to avoid large changes in torque being applied to the web.

Figure 12:
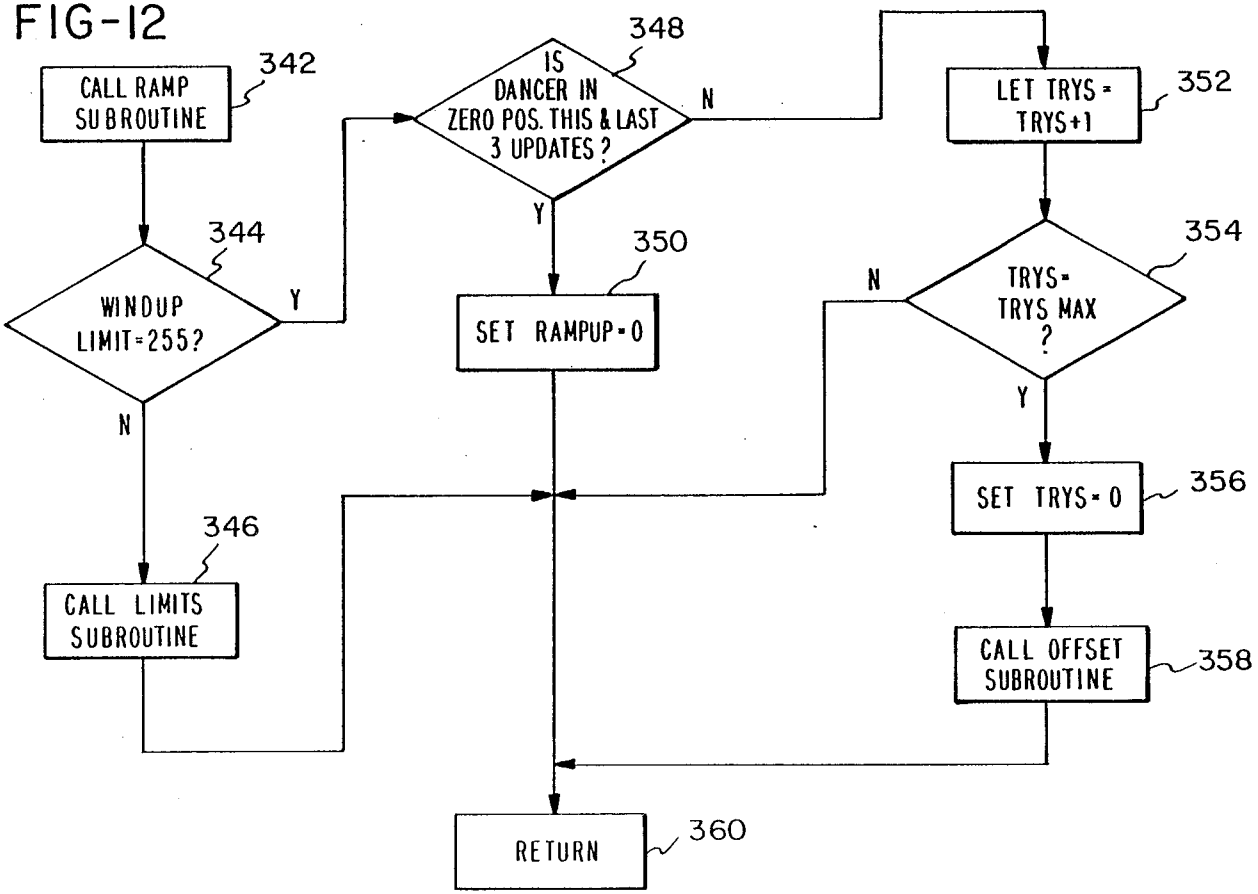

The ramp subroutine can be seen in FIG. 12, and is entered at block 342. An inquiry is made at block 344 as to whether the windup limit is presently at a value of 255. It will be recalled that upon startup, this limit, along with the payout limit, is set to the zero torque value. Regardless of the torque value to be output from the system as determined by the position of the dancer arm, the torque value will not be permitted to exceed the limit value. Eventually, as will be seen below, the limit values will reach the system limits, i.e., for the payout limit a value of zero will be reached, while for the windup limit a value of 255 will be reached.

Figure 11:
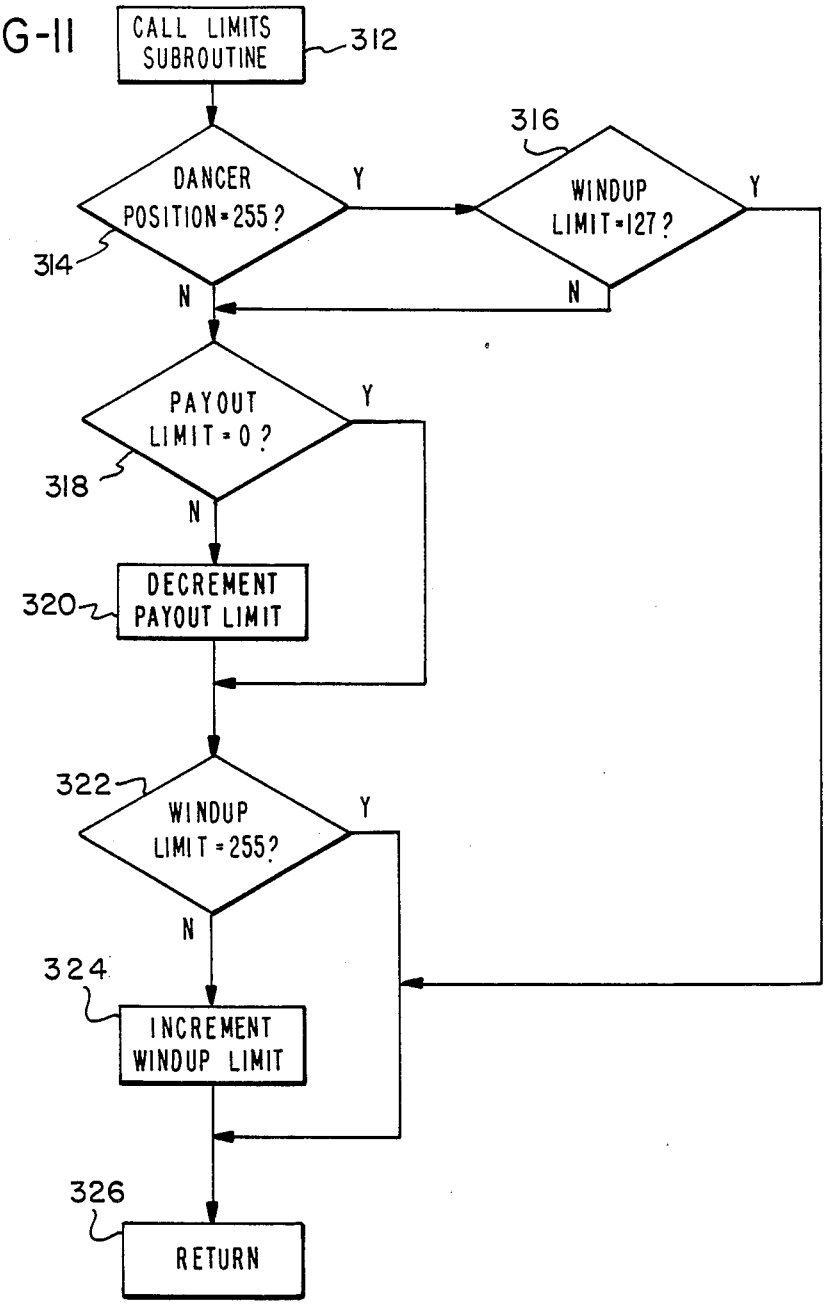

In the early portion of system operation, then, the windup limit will be less than 255, and the program will move to block 346, where the limits subroutine is called. This subroutine can be seen by reference to FIG. 11. Upon entering the subroutine at block 312, an inquiry is made at block 314 as to whether the dancer is in its maximum position corresponding to the dancer roll fully extended into the web (i.e., 255). If it is in this maximum position, an inquiry is next made at block 316 as to whether the wind-up limit is equal to the zero torque value, which in the example described herein is 127. Most commonly, the dancer position will be at a maximum value during start-up of the apparatus. In such a case, the wind-up limit will also be at its initially set value of the zero torque value (corresponding to a digital output of 127 in the present case). Thus, the inquiry at blocks 314 and 316 will both be in the affirmative and the subroutine bypasses any changes in the limits. As a result, no wind up torque will be applied to the supply roll. This prevents the roll from being wound to bring the dancer arm into its centered position. Rather, since no torque will be applied to the roll, the system will simply await the forward advance of the web through the system by other drive means (see FIG. 1).

Once the dancer arm begins to be moved inwardly from its fully extended position, the program will move to block 318. Alternatively, if during system operations, the dancer arm should reach its maximum extended position, the wind up limit should be greater than the initially set zero torque value, and the program will move to block 318. Here, a check is made to determine whether the pay-out limit exceeds zero, which represents the minimum value for such limit. If the value is not at its limit, the value is decremented at block 320. Next, a check is made as to whether the wind-up limit is less than its maximum value of 255. If so, the limit value is incremented at block 324. Thus, it can be seen that the limit values are gradually incremented or decremented, thereby gradually permitting the torque which can be applied to the roll to be increased. The ramp subroutine is returned to at block 326.

Once the wind up limit has reached its maximum value of 255, the inquiry in block 344, FIG. 12, will be answered affirmatively and the subroutine will branch to block 348. If the system has reached its normal operating state, the dancer arm should be at or close to its centered position, and a check is made at this block as to whether the dancer is and has been in its centered position during the present and last three service updates. However, in making this inquiry, the three least significant bits of the arm position value are dropped, to permit some minimal fluctuations in dancer position about the centered position without causing the system to find that it is not yet ramped to normal operating conditions.

If the dancer arm satisfies the test in block 348, ramping is completed, and the ramp-up flag is reset in block 350 to zero.

In the event that the dancer has not been essentially in its centered position for the present and three preceding service updates, a "tries" counter is incremented at block 352, which counter tracks the number of times the system has checked to determine whether the system is ramped to normal operating conditions. At block 354, the tries counter is checked against a predetermined maximum number of tries, for example four. If the present value is less than the maximum, the system is simply permitted to continue the ramp function. If the maximum is reached, the system interprets this condition as requiring a change in the offset function presently used in determining the output torque value. In such a case, the tries counter is reset at block 356 to permit the full number of tries at the new offset value, and the offset subroutine is called at block 358. This subroutine has already been described, and reference is made back to FIG. 10 and the accompanying description.

Regardless of the path taken through the ramp subroutine, a return is made to the main program at block 360.

The program now awaits the next service update. By referring briefly back to the servo-interrupt routine shown in FIG. 9, it can be seen that the dancer position value cannot be changed at block 252 unless the service flag value is equal to one. Further, it will be recalled that neither the offset nor ramp subroutines can be called unless the service flag value is equal to zero (block 240 in FIG. 8). Thus, in the event the interrupt is called while the offset or limits subroutines are being executed, the dancer position value used in carrying out the subroutines cannot be changed. This is important, since changing this value during execution of these subroutines could produce results which do not accurately reflect the status of the apparatus. After completion of these subroutines, the service flag is again set to 1 at block 328, FIG. 8, and the main program enters the loop including blocks 240 and 242.

In the event the stand-by mode is now requested, the program branches from block 242 to block 330, where the timer interrupt is stopped and disabled. The program then loops to its beginning, where upon reaching block 224, the program will remain in a loop until the apparatus is again placed in the operating mode.

It will be appreciated by those skilled in the art that torque control enabled by the disclosed system may also be applied to a take-up roll for the web disposed at the end of the web path opposite the supply roll. While the system as disclosed will properly control the web, it may not allow for changes in take-up roll behavior as a result of roll diameter changes. The control system of the present invention may be easily modified, in accordance with the teachings herein, to also provide a second torque signal to a torque motor acting upon the take-up roll.

One advantage of the present system which should be recognized is that the web handling system operates with contact only along one side of the web. This is important when the system is used with a web material such as the microencapsulated photosensitive web material previously described. If significant contact is made with the side of the web carrying the capsules, the capsule layer could be damaged, which could in turn degrade the quality of the images produced by the system.

A further important advantage of the present system is the ability of the system to automatically change its response in accordance with changes in system parameters. For example, the system will automatically correct for changes in motor current as a function of torque, changes in spring tension exerted by the spring motor, and the like. The system will also accommodate changes in parameters outside the system per se, but which nonetheless affect system performance. For example, the system will compensate for varying frictional characteristics of the media and supply roll.

In essence, then, the system is an adaptive control system. This is important, since the system is self-regulating, and need not be specifically adjusted for system components, either during initial design and construction, or in the event components are replaced.

While the methods and forms of apparatus herein described constitute preferred embodiments of this invention, it is to be understood that the invention is not limited to these precise methods and forms of apparatus, and that changes may be made in either without departing from the scope of the invention which is defined in the appended claims.

What is claimed is:

1. Apparatus for controlling tension in a movable web, comprising:

frame means for supporting a supply roll from which the web may be drawn:

means for applying torque to the supply roll;

means connected to said frame means for defining a nominal web path and for locating the web along said nominal path;

means positioned along said path for measuring displacement of the web from said nominal path, and for generating a signal representative of said web displacement;

control means connected to said displacement measuring means for receiving said displacement signal and generating in response thereto a torque signal representative of a torque value to be applied to the supply roll to return the web to said nominal path;

said control means further being connected to said torque applying means for controlling said torque applying means in accordance with said torque signal;

said control means including:

a plurality of tables incrementally ordered, each said table having a plurality of said torque values;

said control means operating by mapping said web displacement to one of said torque values within a selected one of said tables;

clock means for generating a plurality of clock pulses;

comparator means for comparing said web displacement with said nominal path and determining whether said web displacement differs in one direction from said nominal path during any one clock pulse; and table selection means responsive to said comparator means for changing the selected one of said tables whenever said web displacement differs consistently from said nominal path during a predetermined consecutive number of said clock pulses.

2. Apparatus as defined in claim 1 wherein said control means includes a first of said tables having a plurality of torque values each of which is less than a torque necessary to cause the web to be returned to said nominal path, said first table being selected for a limited time period upon start-up of said apparatus.

3. Apparatus as defined in claim 2, wherein said control means is further for selecting said first table during shut-down of said apparatus.

4. Apparatus as defined in claim 1, wherein said control means further includes means for slowing said clock pulses generated by said clock means for a limited time period upon start-up of said apparatus.

5. Apparatus as defined in claim 4, wherein said control means further includes means for slowing said clock pulses generated by said clock means for a limited time period during shut-down of said apparatus.

6. Apparatus as defined in claim 1, wherein said control means includes means for establishing at least one limiting torque value, and means for generating said torque signal from said limiting torque value instead of a selected one of said torque values from said tables for a limited time period upon start-up of said apparatus, in the event said selected torque value exceeds said limiting torque value.

7. Apparatus as defined in claim 6, wherein said control means includes means for generating said torque signal from said limiting torque value instead of a selected one of said torque values from said tables for a limited time period upon shut-down of said apparatus in the event said selected torque value exceeds said limiting torque value.

8. Apparatus for controlling tension in a movable web, comprising:

frame means for supporting a supply roll from which the web may be drawn;

means for applying torque to the supply roll;

means connected to said frame means for defining a nominal web path and for locating the web along said nominal path;

means positioned along said path for measuring displacement of the web from said nominal path, and for generating a signal representative of said web displacement;

control means connected to said displacement measuring means for receiving said displacement signal and generating in response thereto a torque signal representative of a torque value to be applied to the supply roll to return the web to said nominal path;

said control means further being connected to said torque applying means for controlling said torque applying means in accordance with said torque signal;

said control means including:

means for relating said web displacement value to said torque value in accordance with a plurality of predetermined functions expressing said torque value as a function of web displacement;

means for incrementally ordering said plurality of functions;

clock means for measuring a predetermined time interval;

comparator means for comparing said web displacement with said nominal path and determining whether said web displacement differs in one direction from said nominal path; and function selection means responsive to said comparator means for changing incrementally the selected one of said functions whenever said web displacement differs consistently in said one direction from said nominal path during said predetermined time interval.

9. Apparatus as defined in claim 8, wherein said control means includes a microprocessor.

10. Apparatus as defined in claim 9, wherein said control means further includes operator-actuated input means for programming said microprocessor.

11. Apparatus as defined in claim 8, wherein said means for relating said web displacement value to said torque value includes a first of said functions which generates torque values in accordance with web displacement each of which is less than a torque necessary to cause the web to be returned to said nominal path, and wherein said control means includes means for selecting said first function for a limited time period upon start-up of said apparatus.

12. Apparatus as defined in claim 11, wherein said control means further includes means for selecting said first function during shut-down of said apparatus.

13. Apparatus as defined in claim 8, wherein said control means includes means to establish at least one limiting torque value, and means for generating said torque signal from said limiting torque value instead of a selected one of said torque values from said functions for a limited time period upon start-up of said apparatus, in the event said selected torque value exceeds said limiting torque value.

14. Apparatus as defined in claim 13, wherein said control means includes means for generating said torque signal from said limiting torque value instead of a selected one of said torque values from said functions for a limited time period upon shut-down of said apparatus, in the event said selected torque value exceeds said limiting torque value.

15. Apparatus for controlling tension in a movable web, comprising:

frame means for supporting a supply roll from which the web may be drawn;

means for applying torque to the supply roll;

means connected to said frame means for defining a nominal web path and for locating the web along said nominal path;

means positioned along said path for measuring displacement of the web from said nominal path, and for generating a signal representative of said web displacement;

control means connected to said displacement measuring means for receiving said displacement signal and generating in response thereto a torque signal representative of a torque value to be applied to the supply roll to return the web to said nominal path;

said control means further being connected to said torque applying means for controlling said torque applying means in accordance with said torque signal;

said control means including a plurality of tables, each of said tables having at least one of said torque values, said control means operating by mapping said position to one of said torque values within said tables;

said control means further including:

means for incrementally ordering said plurality of tables;

clock means for measuring a predetermined time interval;

comparator means for comparing said web displacement with said nominal path and determining whether said web displacement differs in one direction from said nominal path; and table selection means responsive to said comparator means for changing incrementally the selected one of said tables whenever said web displacement differs consistently in said one direction from said nominal path during said predetermined time interval.

* * * * *